US007191032B2

(12) United States Patent
MacEwen et al.

(10) Patent No.: US 7,191,032 B2
(45) Date of Patent: Mar. 13, 2007

(54) METHODS OF AND APPARATUS FOR FORMING HOLLOW METAL ARTICLES

(75) Inventors: Stuart R. MacEwen, Inverary (CA); Peter Hamstra, Kingston (CA); Robert William Mallory, Gananoque (CA); Yihai Shi, Kingston (CA); James D. Moulton, Kingston (CA)

(73) Assignee: Novelis Inc., Toronto (CA)

( * ) Notice: Subject to any disclaimer, the term of this patent is extended or adjusted under 35 U.S.C. 154(b) by 28 days.

(21) Appl. No.: 11/125,565

(22) Filed: May 9, 2005

(65) Prior Publication Data

US 2005/0252263 A1 Nov. 17, 2005

Related U.S. Application Data

(60) Provisional application No. 60/571,472, filed on May 14, 2004.

(51) Int. Cl.
*G06F 19/00* (2006.01)

(52) U.S. Cl. ..... 700/197; 72/58; 220/562

(58) Field of Classification Search ..... 700/197, 700/159, 201; 72/58, 61, 62, 52, 80, 405, 72/421; 220/356, 612, 562
See application file for complete search history.

(56) References Cited

U.S. PATENT DOCUMENTS

| | | | | |
|---|---|---|---|---|
| 840,091 | A | | 1/1907 | Schmacher et al. |
| 2,238,037 | A | | 4/1941 | Cornell, Jr. |
| 2,592,867 | A | | 4/1952 | Cuq |
| 3,040,684 | A | | 6/1962 | Hillgren |
| 3,681,960 | A | | 8/1972 | Tadokoro |
| 3,896,648 | A | | 7/1975 | Schertenlieb |
| 3,919,871 | A | | 11/1975 | Andrasev et al. |
| 4,265,102 | A | | 5/1981 | Shimakata et al. |
| 4,362,037 | A | | 12/1982 | Whitfield |
| 4,416,133 | A | * | 11/1983 | Doyle ..... 72/58 |
| 4,441,354 | A | * | 4/1984 | Bodega ..... 72/342.1 |
| 4,774,826 | A | | 10/1988 | Hann |
| 5,187,962 | A | | 2/1993 | Bilko et al. |
| 5,740,692 | A | * | 4/1998 | Dunwoody ..... 72/347 |
| 5,778,723 | A | | 7/1998 | Diekhoff et al. |
| 5,822,843 | A | | 10/1998 | Diekhoff et al. |
| 5,829,290 | A | | 11/1998 | Harvey |
| 5,832,766 | A | | 11/1998 | Hartman et al. |

(Continued)

FOREIGN PATENT DOCUMENTS

| | | |
|---|---|---|
| CA | 2445582 | 11/2002 |
| DE | 3 716 176 | 9/1988 |
| EP | 269 773 | 10/1991 |
| EP | 0 740 971 | 11/1996 |

(Continued)

*Primary Examiner*—Kidest Bahta
(74) *Attorney, Agent, or Firm*—Cooper & Dunham LLP

(57) ABSTRACT

In hydroforming of hollow metal articles in a die, such as pressure-ram-forming procedures, a method of decreasing cycle time of the forming process, while ensuring acceptable product properties and avoiding failures, by modeling the process using finite element analysis to establish a pressure-time history that optimizes the forming operation and applies failure limits to selected variables such as minimum wall thickness or maximum strain rate, and transferring this pressure-time history to a computer controlling the forming process. Thermocouple and/or continuity sensors are incorporated into the die wall and connected to the computer so as to provide active feedback from the die to the control of the process.

35 Claims, 24 Drawing Sheets

U.S. PATENT DOCUMENTS

| | | | | |
|---|---|---|---|---|
| 5,944,216 | A * | 8/1999 | Inaoka et al. | 220/562 |
| 5,992,197 | A | 11/1999 | Freeman et al. | |
| 6,182,487 | B1 | 2/2001 | Komiya et al. | |
| 6,332,346 | B2 * | 12/2001 | Komiya et al. | 72/58 |
| 6,442,988 | B1 | 9/2002 | Hamstra et al. | |
| 6,631,630 | B1 | 10/2003 | Pourboghrat et al. | |
| 6,640,149 | B1 | 10/2003 | Nardini et al. | |
| 6,802,196 | B2 | 10/2004 | Gong et al. | |
| 2004/0194522 | A1 | 10/2004 | Hamstra et al. | |

FOREIGN PATENT DOCUMENTS

| | | |
|---|---|---|
| JP | 10-146879 | 6/1998 |
| JP | 10-146880 | 6/1998 |
| JP | 2004 351478 | 12/2004 |
| WO | WO 97/12704 | 4/1997 |

* cited by examiner

METHODS OF AND APPARATUS FOR FORMING HOLLOW METAL ARTICLES

CROSS REFERENCE TO RELATED APPLICATION

This application claims the priority benefit, under 35 U.S.C. §119(e), of U.S. provisional patent application No. 60/571,472 filed May 14, 2004, the entire disclosure of which is incorporated herein by this reference.

BACKGROUND OF THE INVENTION

This invention relates to methods of and apparatus for forming hollow metal articles utilizing internal fluid pressure to expand a hollow metal preform or workpiece against a die cavity, and especially to pressure-ram-forming methods and apparatus and the like. In an important specific sense, the invention is directed to methods of and apparatus for forming aluminum or other hollow metal articles having a contoured shape, e.g. such as a bottle shape with asymmetrical features. For purposes of illustration particular reference will be made herein to forming metal containers, but the invention in its broader aspects is not limited thereto.

Metal cans are well known and widely used for beverages. Present day beverage can bodies, whether one-piece "drawn and ironed" bodies, or bodies open at both ends (with a separate closure member at the bottom as well as at the top), generally have simple upright cylindrical side walls. It is sometimes desired, for reasons of aesthetics, consumer appeal and/or product identification, to impart a different and more complex shape to the side wall and/or bottom of a metal beverage container, and in particular, to provide a metal container with the shape of a bottle rather than an ordinary cylindrical can shape. Conventional can-producing operations, however, do not achieve such configurations.

Copending U.S. patent application Ser. No. 10/284,912 (patent application Publication No. US 2003/0084694 A1), now allowed, the entire disclosure of which is incorporated herein by this reference, describes convenient and effective methods of and apparatus for forming metal workpieces into hollow metal articles having bottle shapes or other complex shapes, including methods and apparatus capable of forming contoured shapes that are not radially symmetrical, to enhance the variety of designs obtainable.

In particular, copending application Ser. No. 10/284,912 describes a method of forming a hollow metal article such as a container of defined shape and lateral dimensions, comprising disposing a hollow metal preform having a closed end in a die cavity laterally enclosed by a die wall defining the shape and lateral dimensions, with a punch located at one end of the cavity and translatable into the cavity, the preform closed end being positioned in proximate facing relation to the punch and at least a portion of the preform being initially spaced inwardly from the die wall; subjecting the preform to net internal fluid pressure to expand the preform outwardly into substantially full contact with the die wall, thereby to impart the defined shape and lateral dimensions to the preform, the fluid pressure exerting force, on the preform closed end, directed toward the aforesaid one end of the cavity; and, either before or after the preform begins to expand but before expansion of the preform is complete, translating the punch into the cavity to engage and displace the closed end of the preform in a direction opposite to the direction of force exerted by fluid pressure thereon, deforming the closed end of the preform. Translation of the punch is effected by a ram which is capable of applying sufficient force to the punch to displace and deform the preform. This method is referred to as a pressure-ram-forming (PRF) procedure, because the container is formed both by applied internal fluid pressure and by the translation of the punch by the ram. The term "net internal fluid pressure" as used herein means a positive interior-to-exterior pressure differential across the preform wall.

The punch has a contoured (e.g. domed) surface, the closed end of the preform being deformed so as to conform to the contoured surface. The die cavity has a long axis, with the preform having a long axis and being disposed substantially coaxially within the cavity, and the punch being translatable along the long axis of the cavity. When the die wall comprises a split die (made up of two or more mating segments around the periphery of the die cavity) separable for removal of the formed hollow metal articles, the defined shape may be asymmetric about the long axis of the cavity; i.e., PRF forming can produce an asymmetric profile (for example, feet on the bottom or spiral ribs on the side of the container).

The punch is preferably initially positioned close to or in contact with the preform closed end, before the application of fluid pressure, in order to limit axial lengthening of the preform by the fluid pressure. Translation of the punch may be initiated after the expanding lower portion of the preform has come into contact with the die wall.

The preform, especially when the hollow metal article to be formed is a bottle-shaped container or the like, is preferably an elongated and initially generally cylindrical workpiece having an open end opposite its closed end. It may be substantially equal in diameter to the neck portion of the bottle shape, and may have sufficient formability to be expandable to the defined shape in a single pressure forming operation. If it lacks such formability, preliminary steps of placing the workpiece in a die cavity smaller than the first-mentioned die cavity, and subjecting the workpiece therein to internal fluid pressure to expand the workpiece to an intermediate size and shape smaller than the defined shape and lateral dimensions, are performed prior to the PRF method described above. Alternatively, if the elongated and initially generally cylindrical workpiece is larger in initial diameter than the neck portion of the bottle shape, the method of forming a bottle-shaped container may include a step of subjecting the workpiece, adjacent its open end, to a necking operation to form a neck portion of reduced diameter, after performance of the PRF procedure; or the diameter of the neck area of the preform can be reduced using a die necking procedure which may be applied before the expansion stage.

During the step of subjecting the preform to internal fluid pressure, the fluid pressure within the preform occurs in successive stages of (i) rising to a first peak before expansion of the preform begins, (ii) dropping to a minimum value as expansion commences, (iii) rising gradually to an intermediate value as expansion proceeds until the preform is in extended though not complete contact with the die wall, and (iv) rising from the intermediate pressure during completion of preform expansion. Stated with reference to this sequence of pressure stages, the initiation of translation of the punch to displace and deform the closed end of the preform in a preferred embodiment of the invention occurs substantially at the end of stage (iii).

Typically, when the internal fluid pressure is applied, the closed end of the preform assumes an enlarged and generally hemispherical configuration as the preform comes into contact with the die wall; and initiation of translation of the punch occurs substantially at the time that the preform closed end assumes this configuration.

The step of subjecting the preform to internal fluid pressure may comprise simultaneously applying internal positive fluid pressure and external positive fluid pressure to the preform in the cavity, the internal positive fluid pressure being higher than the external positive fluid pressure. The internal and external pressure are respectively provided by two independently controllable pressure systems. Strain rate in the preform is controlled by independently controlling the internal and external positive fluid pressures to which the preform is simultaneously subjected for varying the differential between the internal positive fluid pressure and the external positive fluid pressure. In this way, more precise control of the strain rates may be achieved. In addition, the increased hydrostatic pressure may reduce deleterious effects of damage (voids) associated with the microstructure of the material.

Heat may be applied during expansion of the preform, so as to induce a temperature gradient in the preform. By adding heaters to the punch, a temperature gradient is induced in the preform from the bottom up. Separate heaters may be added at the top of the die which induce a temperature gradient in the preform from the top down. Further heaters may be included in the side walls of the die cavity.

It has also been found advantageous to have the punch in contact with the bottom of the preform before the start of the expansion phase and to apply some axial load by the punch throughout the expansion phase. With this procedure where the punch applies some axial load to the closed end of the preform throughout the expansion phase, the displacement and deformation of the preform closed end are preferably not carried out until completion of the expansion phase.

Internal and external positive fluid pressures may be applied by feeding gas to the interior of the preform and to the die cavity externally of the preform, respectively, through separate channels. Heat may be applied to the preform by multiple groups of heating elements respectively incorporated in upper and lower portions of the die structure and under independent temperature control for controlling temperature gradient in the preform. Additionally or alternatively, heat may be applied to the preform by a heating element disposed within the preform substantially coaxially therewith; and heat may be further supplied to the preform by heating the punch.

In addition, where the neck portion of the defined container shape includes a screw thread or lug for securing a screw closure to the formed article, and/or a neck ring, the die wall may have a neck portion with a thread or lug formed therein for imparting a thread to the preform during expansion of the preform.

Heretofore, in pressure-ram-forming operations emphasis has been given to the reliable production of articles such as containers to meet customer requirements, utilizing pressures which are "safe" (from the standpoint of avoiding failures) and consequent relatively long cycle times. As used herein, "failure" means a structural flaw such as a pinhole or split in the produced article, resulting from a defect in the manufacture of the preform and/or an inherent limit to the formability of the alloy.

For the sake of manufacturing economy, however, it would be desirable to decrease the cycle time (time for forming one container or other article) of the PRF process while achieving acceptable forming properties and, in particular, avoiding failures in the produced articles. More generally, it would be desirable to achieve improved computer control of complex forming processes such as the PRF process.

SUMMARY OF THE INVENTION

The present invention, in a first aspect, contemplates the provision of a method executed by a computer system as part of a computer-implemented program for optimizing pressure-time history for a process for forming a workpiece from an initial hollow metal preform into a hollow metal article within a die by subjecting the workpiece to net internal fluid pressure such that the workpiece expands into contact with an article-shape-defining wall of the die, while avoiding failure of the workpiece, comprising the steps of selecting a set of process parameters including temperature and preform material properties and dimensions; determining, from the set of parameters, at least one failure criterion limiting pressure-time conditions to which the workpiece may be subjected without failure; and iteratively performing finite element analyses on the workpiece, based on the selected set of parameters and the determined failure criterion, at each of a plurality of different values of pressure-time conditions (P, t), to determine pressure-time boundary conditions ($P_b$, $t_b$) for the process, wherein each value of pressure-time conditions comprises a value of net internal fluid pressure (P) and a time interval (t) over which the last-mentioned value of net internal fluid pressure is applied to the workpiece.

The failure criterion may be selected from the group consisting of minimum wall thickness, strain, and strain rate.

The step of determining ($P_b$, $t_b$) may include selecting a time interval and iteratively performing said finite element analyses on the workpiece at each of a plurality of different pressure values, to determine, as a boundary condition, a value of maximum net internal fluid pressure to which the workpiece can be subjected for said time interval without failure.

Additionally, the method may include steps of determining a second set of process parameters corresponding to the first-mentioned set of process parameters but modified by deformation imposed on the workpiece by subjection to the first-mentioned pressure-time boundary conditions ($P_{b1}$, $t_{b1}$); determining, from the second set of process parameters, at least one second failure criterion; and determining, by iteratively performed finite element analyses based on the second set of parameters and the determined second failure criterion, second pressure-time boundary conditions ($P_{b2}$, $t_{b2}$) for the process.

These steps may be repeated to determine a plurality n of pressure-time boundary conditions wherein $3 \leqq n$; and wherein, for each integer I such that $3 \leqq i \leqq n$, the ith set of process parameters corresponds to the (i−1)th set of process parameters but modified by deformation imposed on the workpiece by subjection to the (i−1)th pressure-time boundary conditions ($P_{bi-1}$, $t_{bi-1}$), the ith failure criterion is determined from the ith set of process parameters, and the ith pressure-time boundary conditions ($P_{bi}$, $t_{bi}$) are determined by iteratively performed finite element analyses based on the ith set of parameters and the determined ith failure criterion, thereby to determine n successive sets of pressure-time boundary conditions ($\{P_{b1}, t_{b1}\}, \ldots \{P_{bn}, t_{bn}\}$) collectively constituting an optimized pressure-time history for the process.

In the latter method, at least one set of pressure-time boundary conditions may be determined by iteratively performed finite element analyses as aforesaid at each of a plurality of values of pressure (P) for a preselected value of time (t) Alternatively, at least one set of pressure-time boundary conditions is determined by iteratively performed finite element analyses as aforesaid at each of a plurality of values of time (t) for a preselected value of pressure (P).

The invention in a further aspect embraces a process for forming a hollow metal article of defined shape and lateral dimensions, comprising the steps of disposing a hollow metal preform having a closed end in a die cavity laterally enclosed by a die wall defining the aforesaid shape and lateral dimensions, the preform closed end being positioned in facing relation to one end of the cavity and at least a portion of the preform being initially spaced inwardly from the die wall, and, under control of a computer, subjecting the preform to net internal fluid pressure to expand the preform outwardly into substantially full contact with the die wall, thereby to impart said defined shape and lateral dimensions to the preform, the net fluid pressure exerting force, on the closed end, directed toward the aforesaid one end of the cavity, wherein the improvement comprises supplying, to the computer, an optimized pressure-time history for the process determined as described above, and subjecting the preform to n successive sets of pressure-time conditions respectively corresponding to n successive sets of pressure-time boundary conditions ($\{P_{b1}, t_{b1}\}, \ldots \{P_{bn}, t_{bn}\}$) constituting the optimized pressure-time history; or wherein the improvement comprises subjecting the preform to a succession of sets of pressure-time conditions (p, t), respectively having successively decreasing values of net internal fluid pressure, the succession of sets of pressure-time conditions being within predetermined boundary conditions for the process.

Additionally, the invention embraces a PRF process for forming a hollow metal article (e.g., a metal container) of defined shape and lateral dimensions, comprising disposing a hollow metal preform having a closed end in a die cavity laterally enclosed by a die wall defining the shape and lateral dimensions, with a punch located at one end of the cavity and translatable into the cavity, the preform closed end being positioned in proximate facing relation to the punch and at least a portion of the preform being initially spaced inwardly from the die wall; under control of a computer, subjecting the preform to net internal fluid pressure to expand the preform outwardly into substantially full contact with the die wall, thereby to impart the defined shape and lateral dimensions to the preform, the fluid pressure exerting force, on the closed end of the preform, directed toward the aforesaid one end of the cavity; and translating the punch into the cavity to engage and displace the closed end of the preform in a direction opposite to the direction of force exerted by fluid pressure thereon, deforming the closed end of the preform; wherein the improvement comprises supplying, to the computer, pressure-time boundary conditions determined for said process by the method described above, and subjecting the preform to pressure-time conditions corresponding to those pressure-time boundary conditions.

More particularly, the PRF process may include the steps of determining, for the preform, a failure criterion (e.g., a limiting value of strain rate) limiting pressure-time conditions to which the workpiece may be subjected without failure; by iteratively performing finite element analyses on the preform, developing a pressure-time history for the preform comprising an initial value of net internal fluid pressure, an initial time interval during which pressure at the initial value is to be applied to the preform, a plurality of sequential time intervals following the initial interval, and a corresponding plurality of successively lower values of net internal fluid pressure to be respectively applied to the preform during the plurality of sequential time intervals, wherein the values of internal fluid pressure and the durations of the time intervals are such that the failure criterion is never exceeded throughout the pressure-time history; supplying the pressure-time history to the computer; and subjecting the preform to net internal fluid pressure by subjecting the preform to the pressure-time history.

A PRF process according to the invention may include the steps of sensing contact of the preform with a preselected location in the die wall and/or sensing temperature conditions to which the preform is subjected during performance of the process, and supplying the sensed information to the computer, wherein computer control of the process is responsive to the supplied information.

The invention additionally contemplates the provision of apparatus for forming a hollow metal article of defined shape and lateral dimensions from a hollow metal preform having a closed end, comprising die structure providing a die cavity for receiving the preform therein with at least a portion of the preform being initially spaced inwardly from the die wall and the preform closed end facing one end of the cavity, said cavity having a die wall defining the aforesaid shape and lateral dimensions; a punch located at one end of the cavity and translatable into the cavity such that the closed end of a preform received within the cavity is positioned in proximate facing relation to the punch; a fluid pressure supply for subjecting a preform within the cavity to net internal fluid pressure to expand the preform outwardly into substantially full contact with the die wall, thereby to impart the aforesaid defined shape and lateral dimensions to the preform, the net internal fluid pressure exerting force, on the closed end of the preform, directed toward the aforesaid one end of the cavity; and a computer for controlling at least one of supply of fluid pressure and translation of the punch; wherein the improvement comprises at least one sensor positioned at a location in the die wall to sense contact of the preform with the die wall at that location, the sensor supplying information representative of the sensed contact to the computer, and computer control of the process being responsive to the supplied contact information.

The sensor may comprise an electrical conductor exposed at the die wall at the aforesaid location and connected to the computer such that when the preform comes into contact with the die wall, contact information is supplied to the computer.

Such apparatus may also include at least one sensor for sensing temperature conditions to which the preform is subjected during performance of the process and supplying information representative of the sensed temperature conditions to the computer, and wherein computer control of the process is responsive to the supplied temperature information.

A modified PRF process for forming a hollow metal article of defined shape and lateral dimensions in accordance with another aspect of the invention comprises steps of disposing a hollow metal preform having opposed ends, one of which is closed, in a die cavity laterally enclosed by a die wall defining the shape and lateral dimensions, the cavity having an axis and a closed inner end faced by the preform closed end, at least a portion of the preform being initially spaced inwardly from the die wall, and a ram translatable axially of the cavity toward the closed inner end and arranged to exert force on the other end of the preform in a direction toward the closed end of the cavity; subjecting the preform to net internal fluid pressure to expand the preform outwardly into substantially full contact with the die wall, thereby to impart the defined shape and lateral dimensions to the preform, the fluid pressure exerting force, on the closed end of the preform, directed toward the aforesaid one end of the cavity; and translating the ram to displace the other end of the preform toward the closed end of the die cavity. In this process, the die wall advantageously comprises a fixed portion adjacent the closed end of the cavity and a movable portion slidable axially of the cavity and arranged for movement with the ram toward the closed end of the cavity from an initial position at which the fixed and movable die wall portions are spaced apart to a limiting position at which the fixed and movable die wall portions are contiguous, the step of translating the ram causing the movable portion of the die wall to move therewith from the initial position to the limiting position.

The closed end of the cavity may be closed by a punch translatable into the cavity; the punch may remain fixed throughout the PRF process, or alternatively, with the preform closed end positioned in proximate facing relation to the punch, the process may include the step of translating the punch into the cavity to engage and displace the closed end of the preform in a direction opposite to the direction of force exerted by fluid pressure thereon, deforming the closed end of the preform.

Translation of the ram, as well as the step of subjecting the preform to net internal fluid pressure, are ordinarily computer-controlled. The process may include steps of sensing contact of the preform with a preselected location in the die wall and supplying information representative of the sensed contact to the computer, computer control of the ram translation being responsive to the supplied information; and/or steps of supplying, to the computer, pressure-time boundary conditions determined for the process by the method described above and subjecting the preform to pressure-time conditions corresponding to the pressure-time boundary conditions thus determined.

The invention in this aspect also embraces apparatus for forming a hollow metal article of defined shape and lateral dimensions from a hollow metal preform having opposed ends of which one is closed, comprising die structure providing a die cavity having an axis and a die wall defining the aforesaid shape and lateral dimensions, for receiving the preform therein with at least a portion of the preform being initially spaced inwardly from the die wall and the preform closed end facing a closed end of the cavity; a ram translatable axially of the cavity toward the closed inner end and disposed to exert force on the other end of the preform in a direction toward the closed inner end of the cavity; and a fluid pressure supply for subjecting a preform within the cavity to internal fluid pressure to expand the preform outwardly into substantially full contact with the die wall, thereby to impart said defined shape and lateral dimensions to the preform, said fluid pressure exerting force, on said closed preform end, directed toward said one end of the cavity.

The die wall preferably comprises a fixed portion adjacent the closed end of the cavity and a movable portion slidable axially of the die cavity and arranged for movement with the ram toward the closed end of the die cavity from an initial position at which the fixed and movable portions are spaced apart to a limiting position at which the fixed and movable die wall portions are contiguous, the step of translating the ram causing the movable portion of the die wall to move therewith from the initial position to the limiting position. The die structure may include an enlarged indentation, for slidably receiving the movable portion of the die wall, spaced from the closed end of the cavity by the fixed die wall portion.

The apparatus may also include a punch closing the closed end of the die cavity. The punch may be translatable into the cavity to engage and displace the closed end of the preform in a direction opposite to the direction of force exerted by fluid pressure thereon. Additionally, where movement of the ram is controlled by a computer, the apparatus may include a sensor for sensing contact of the preform with a preselected location in the die wall and supplying information representative of the sensed contact to the computer.

Further features and advantages of the invention will be apparent from the detailed description hereinafter set forth, together with the accompanying drawings.

Figure 13:
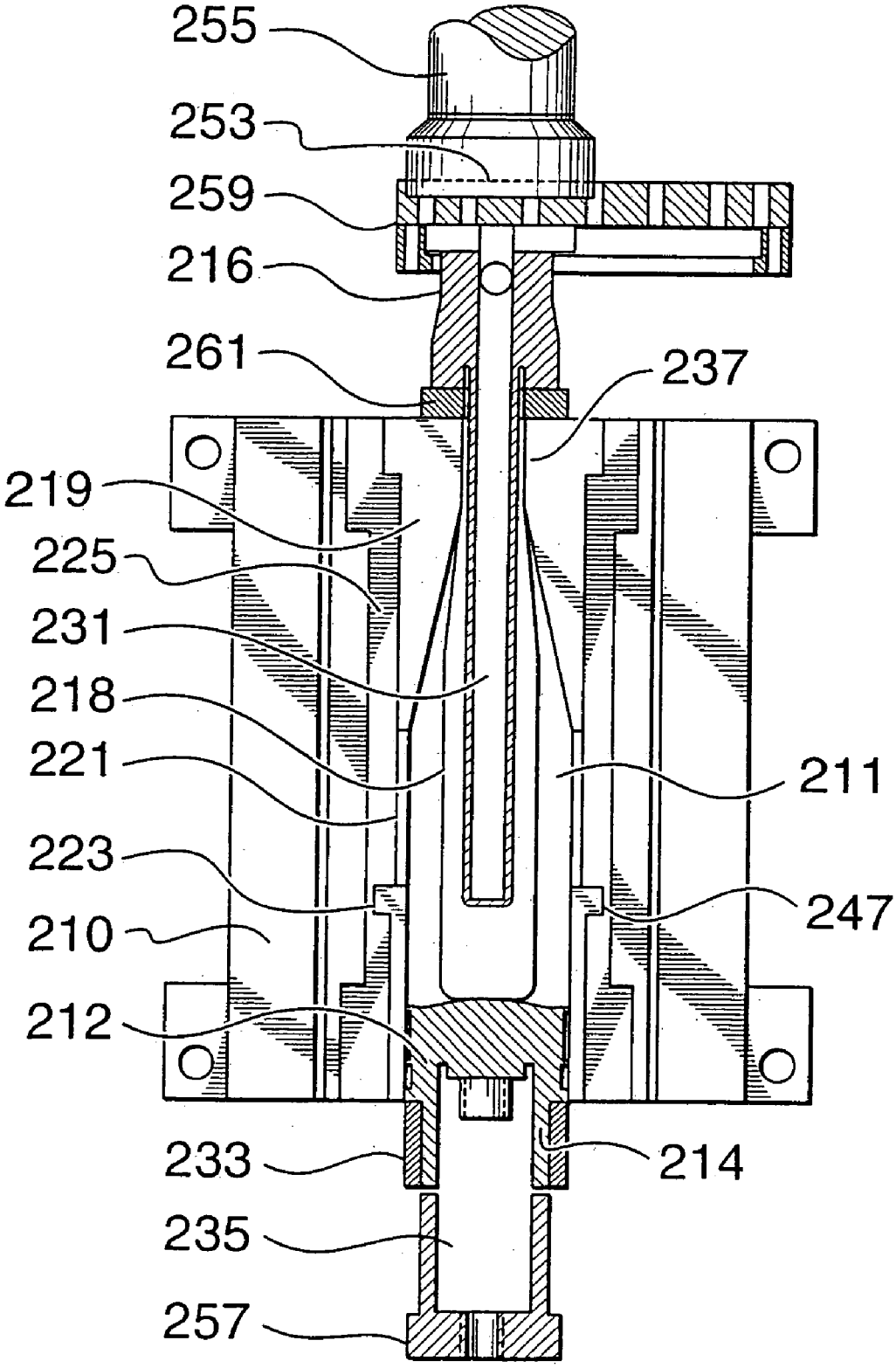
FIG. 13 is an elevational sectional view of an illustrative embodiment of the apparatus of application Ser. No. 10/284,912 for use in performing the method thereof.
Figure 14:
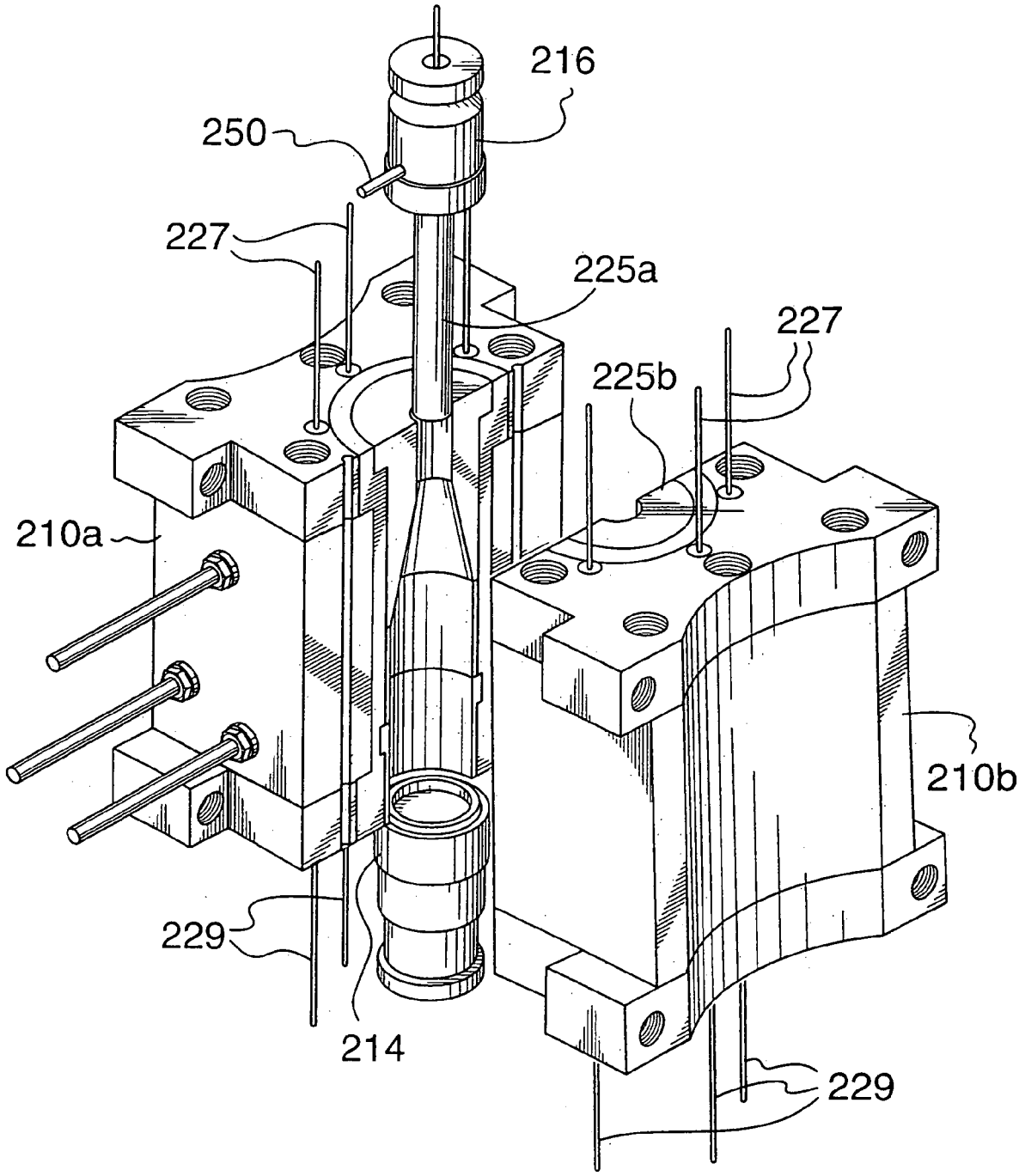
FIG. 14 is a perspective view, partly exploded, of the apparatus of FIG. 13.
Figure 16:
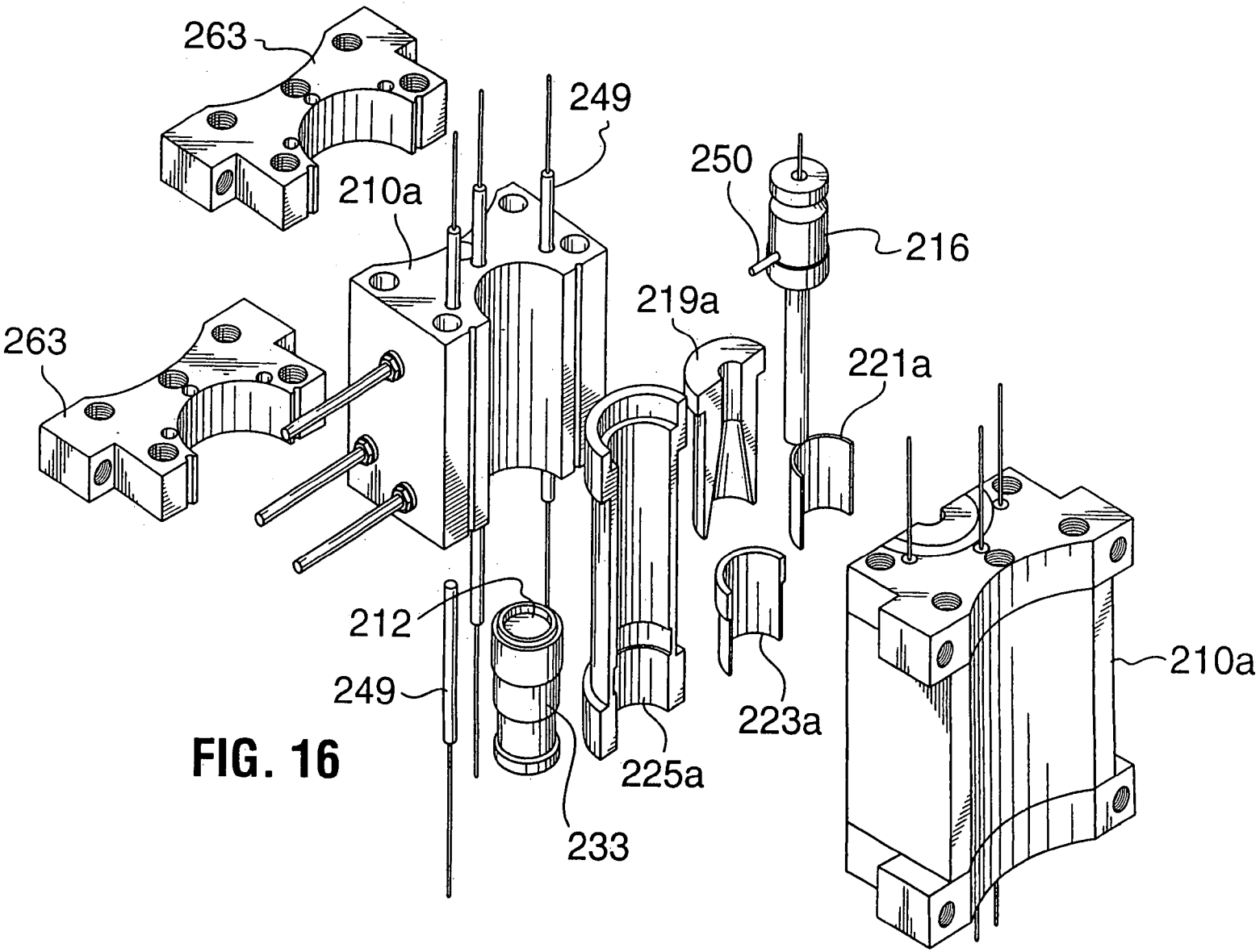
Figure 17:
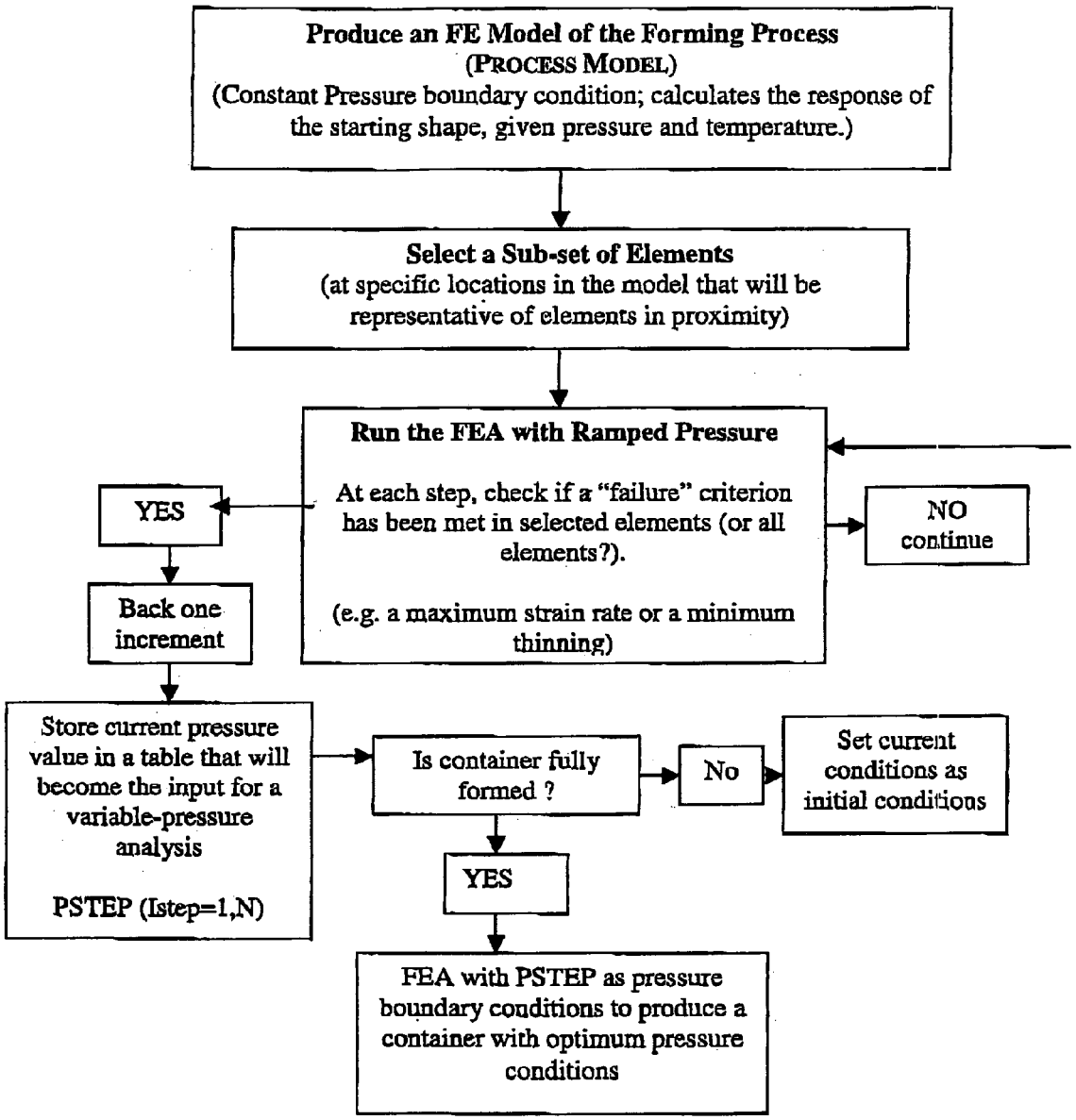
Figure 18A:
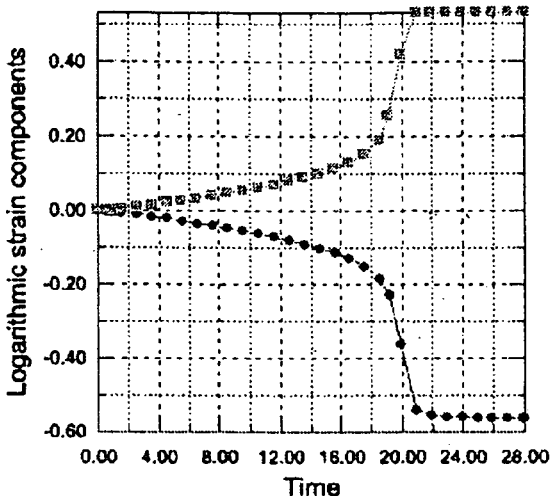
Figure 18B:
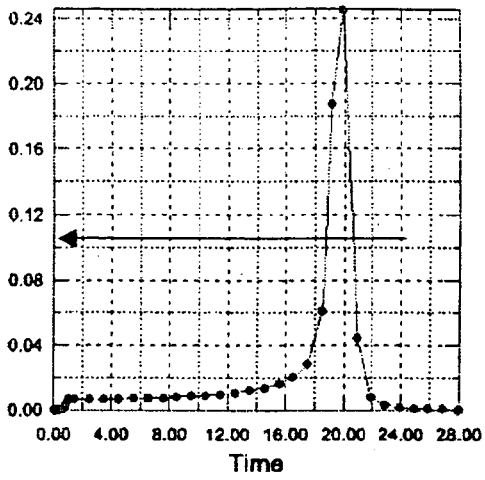
Figure 19:
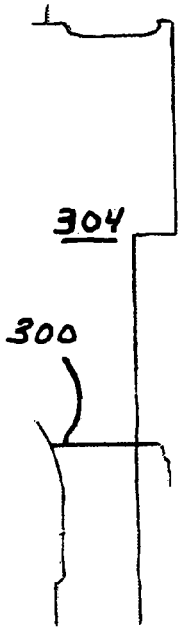
Figure 20:
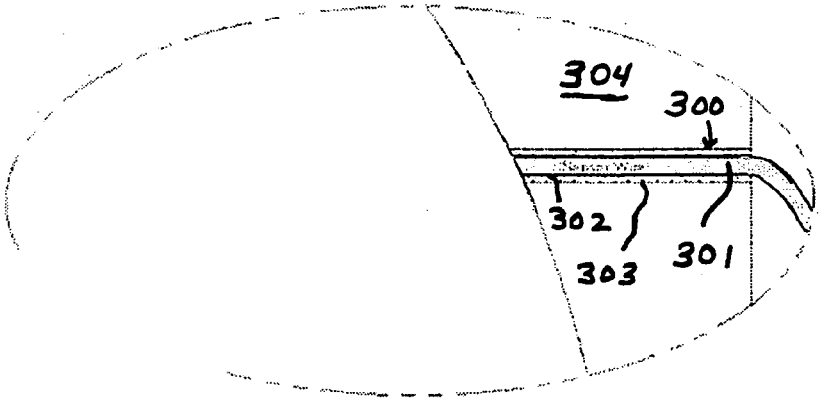
Figure 21:
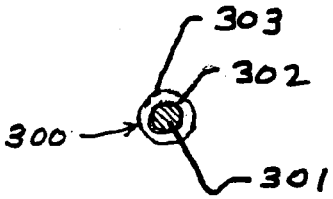
Figure 22:
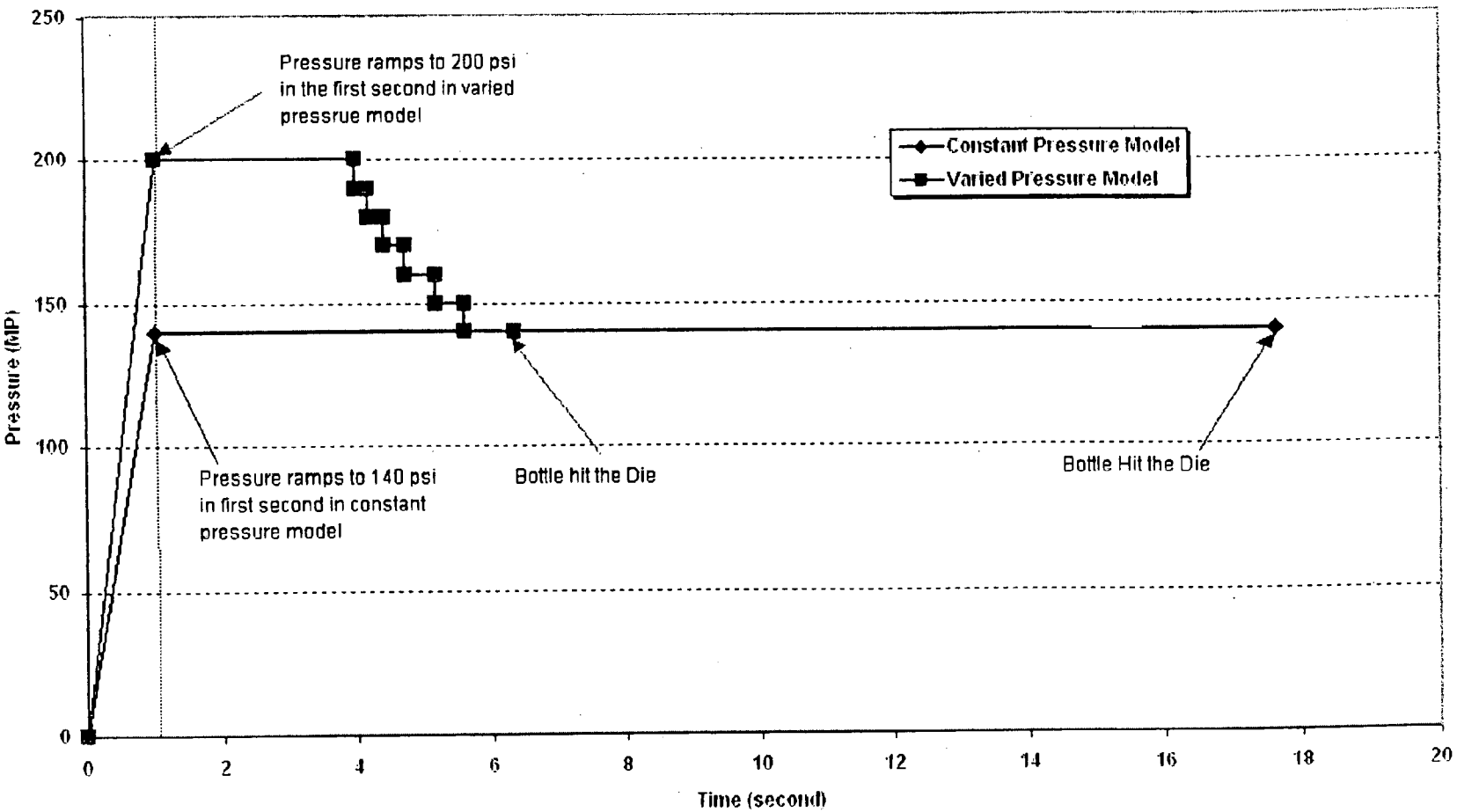
Figure 23:
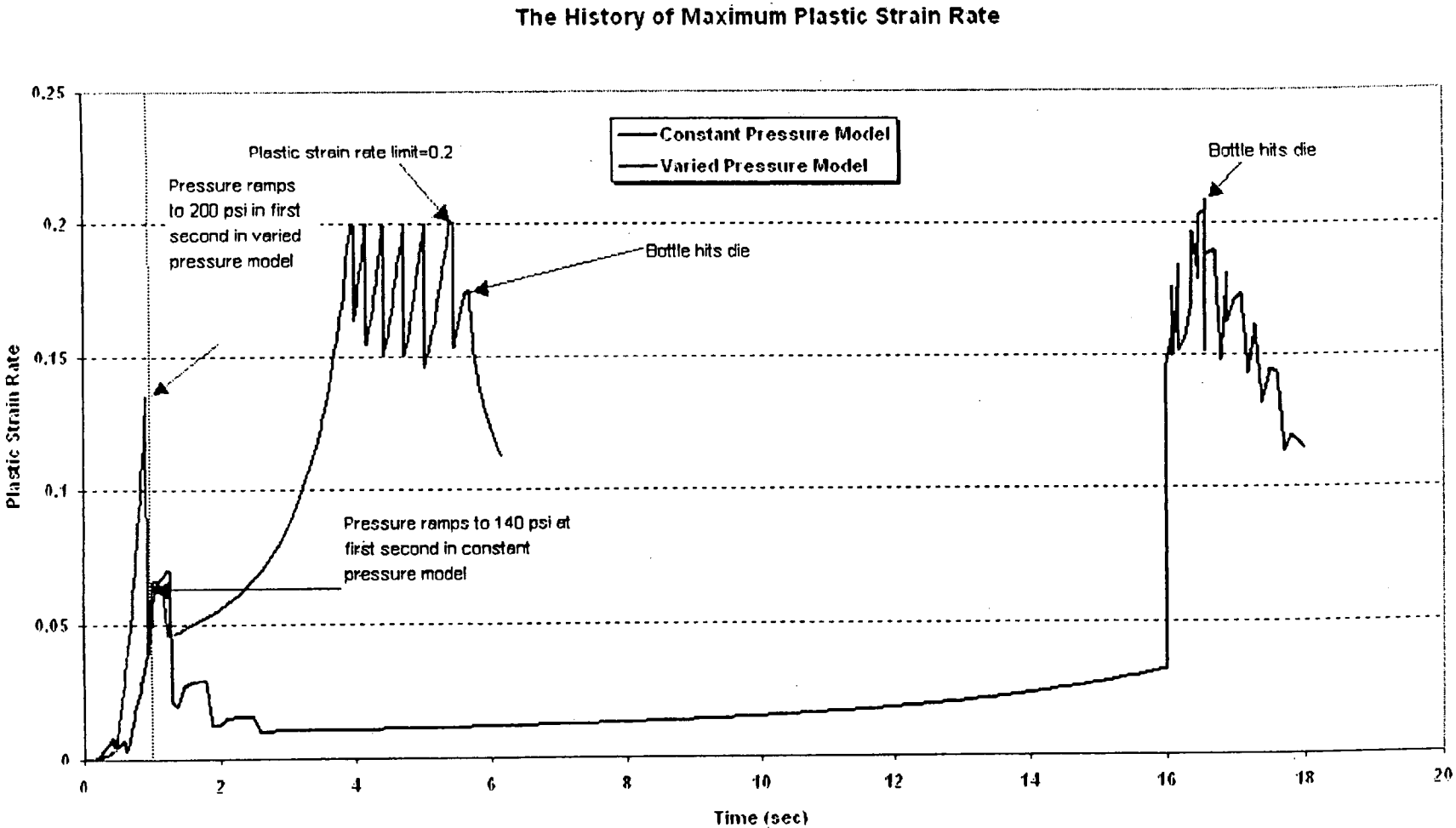
Figure 24:
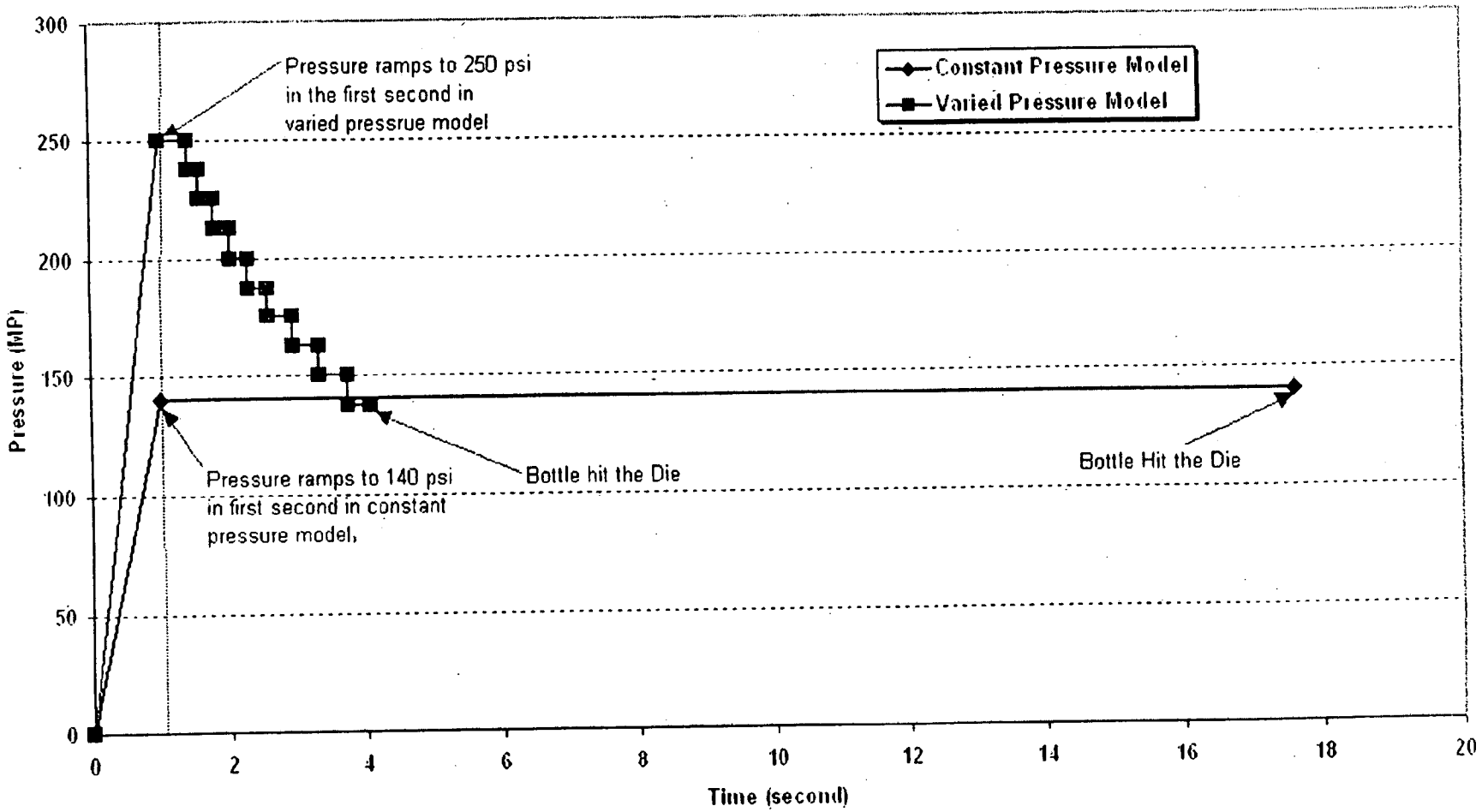
Figure 25:
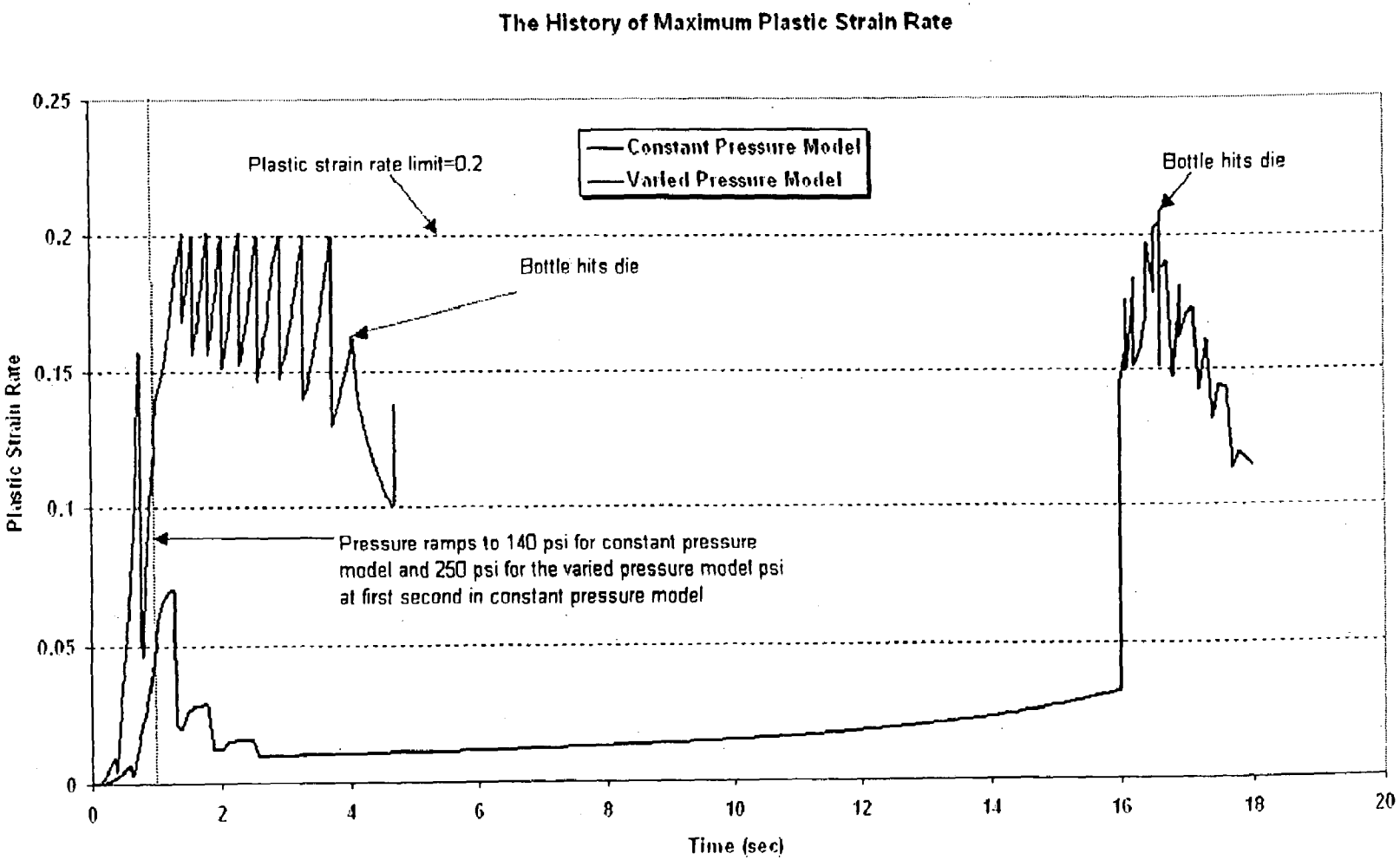
Figure 27:
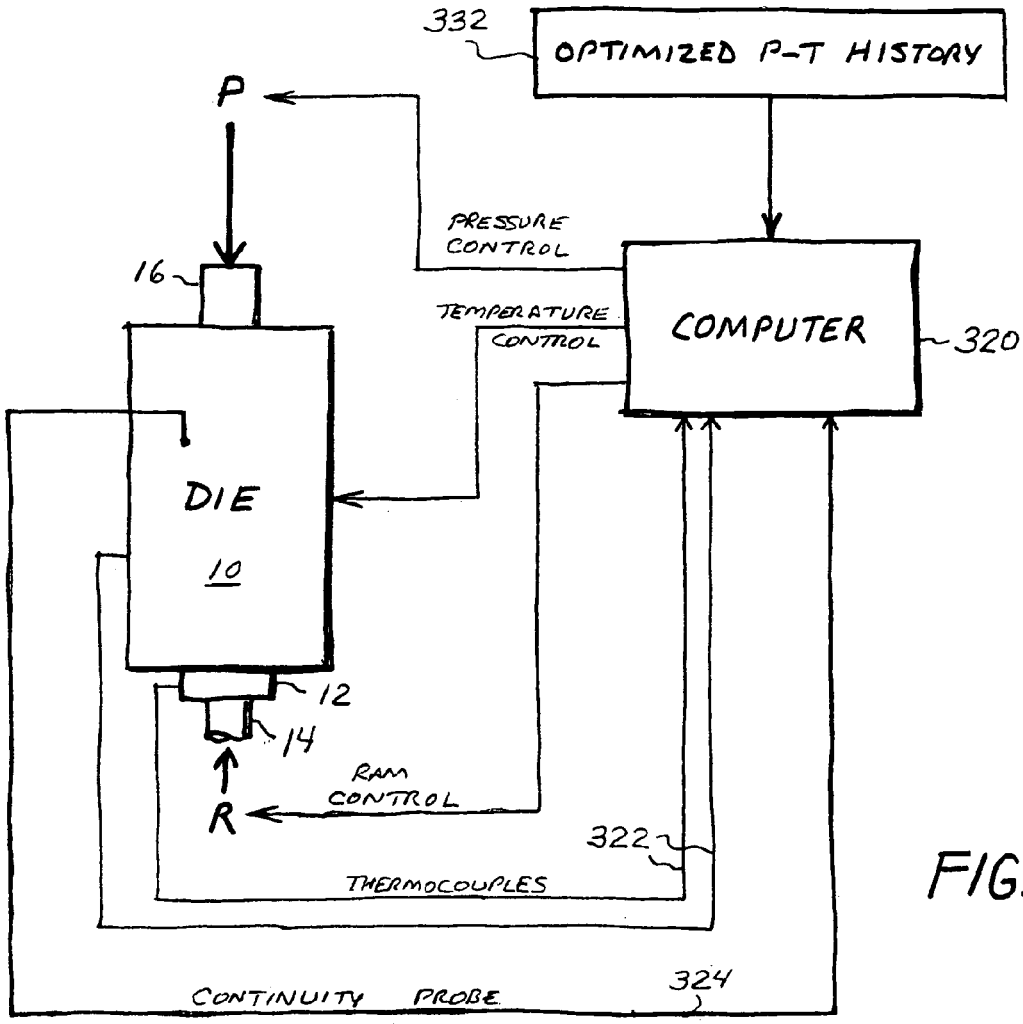
Figure 28:
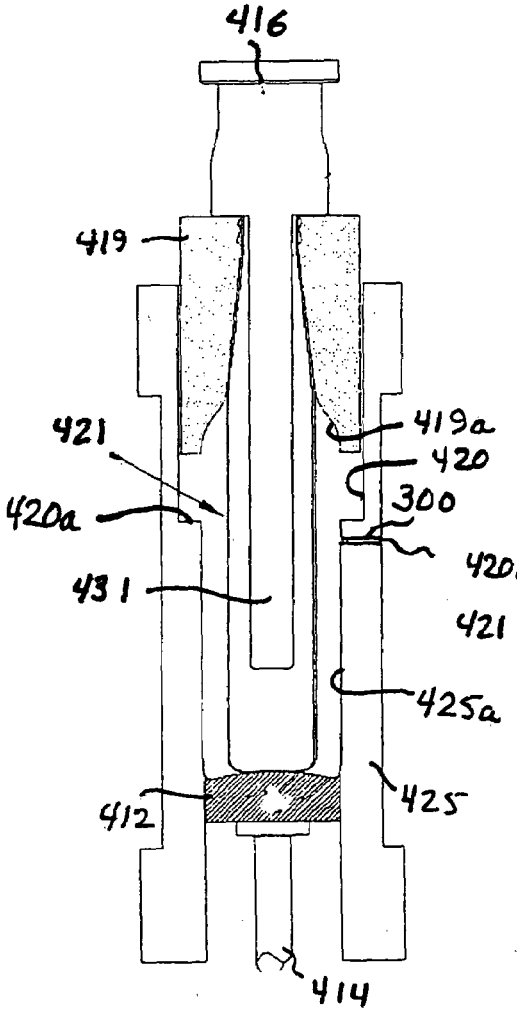
Figure 29:
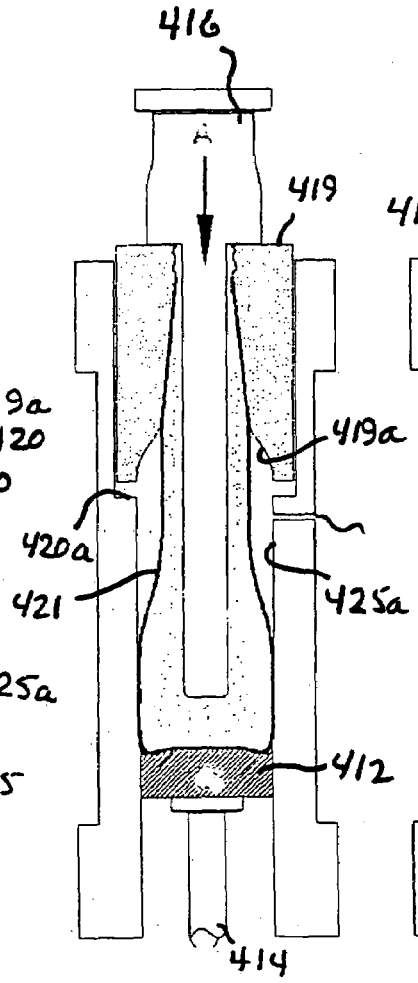
Figure 30:
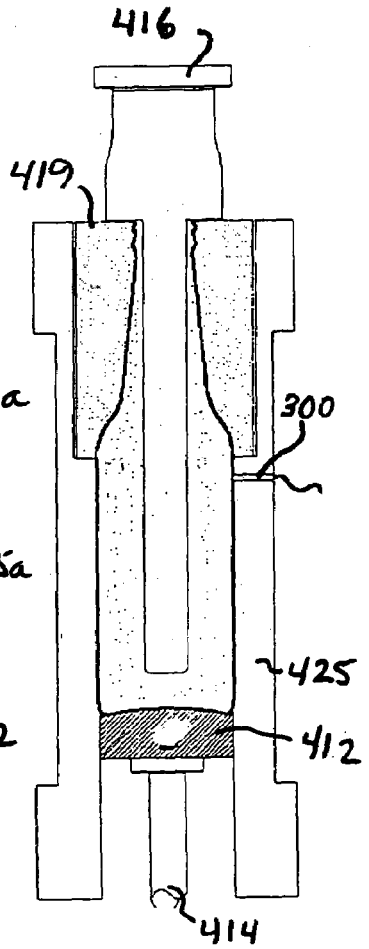

FIG. 16 is a fully exploded perspective view of the apparatus of FIGS. 13 and 14;

FIG. 17 is a conceptual flow chart illustrating an embodiment of the method of the present invention for optimizing pressure-time history for a PRF process or the like;

FIG. 18A is a graph of the evolution of circumferential strain and thickness strain of one element, in finite element analysis of a workpiece undergoing pressure ram forming, as the element moves radially outward under the action of the internal pressure and ram force;

FIG. 18B is a graph of the plastic strain rate for the same element;

FIG. 19 is a fragmentary view of a PRF die showing the location of one illustrative continuity probe in accordance with the invention;

FIG. 20 is an enlarged fragmentary sectional elevational view of the continuity probe of FIG. 19 as mounted in the die;

FIG. 21 is an enlarged cross-sectional view of the continuity probe of FIG. 19;

FIG. 22 is a graph illustrating a first varied pressure model of a pressure time history in accordance with the invention, with pressure plotted against time, and also showing a constant pressure model for comparison;

FIG. 23 is a graph of the strain rate histories of the varied and constant pressure models of FIG. 22;

FIG. 24 is a graph illustrating a second varied pressure model of a pressure time history in accordance with the invention, with pressure plotted against time, and also showing a constant pressure model for comparison;

FIG. 25 is a graph of the strain rate histories of the varied and constant pressure models of FIG. 24;

FIGS. 26A, 26B, 26C and 26D are computer-generated schematic elevational views of workpiece and die in progressive iterations of finite element modeling of the varied pressure model of FIG. 22;

FIG. 27 is a simplified diagram in illustration of a PRF process embodying the invention; and FIGS. 28, 29 and 30 are elevational sectional views, similar to FIG. 13 but somewhat simplified, illustrating a modified PRF apparatus at successive stages in performance of a modified PRF process in accordance with the invention.

DETAILED DESCRIPTION

Pressure-Ram-Forming

To facilitate explanation of novel features of the present invention, the pressure-ram-forming methods and apparatus heretofore disclosed in the aforementioned copending application Ser. No. 10/284,912, will initially be described, with reference to FIGS. 1–16, which illustrate the methods and apparatus of the copending application.

More particularly the method and apparatus of the copending application will be described as embodied in methods of forming aluminum containers having a contoured shape that need not be axisymmetric (radially symmetrical about a geometric axis of the container) using a combination of hydro (internal fluid pressure, whether liquid or gas) and punch forming, i.e., a PRF procedure.

The PRF manufacturing process has two distinct stages, the making of a preform and the subsequent forming of the preform into the final container. Several options for the complete forming path are described in the copending application; the appropriate choice is determined by the formability of the aluminum sheet being used.

The preform is made from aluminum sheet (the term "aluminum" herein referring to aluminum-based alloys as well as pure aluminum metal) having a recrystallized or recovered microstructure and with a gauge, for example, in the range of 0.25 mm to 1.5 mm (PRF forming can also be used to shape hollow metal articles from other materials, such as steel). The preform is a closed-end cylinder that can be made by, for example, a draw-redraw process or by back-extrusion. The diameter of the preform lies somewhere between the minimum and maximum diameters of the desired container product. Threads may be formed on the preform prior to the subsequent forming operations. The profile of the closed end of the preform may be designed to assist with the forming of the bottom profile of the final product.

Figure 1:
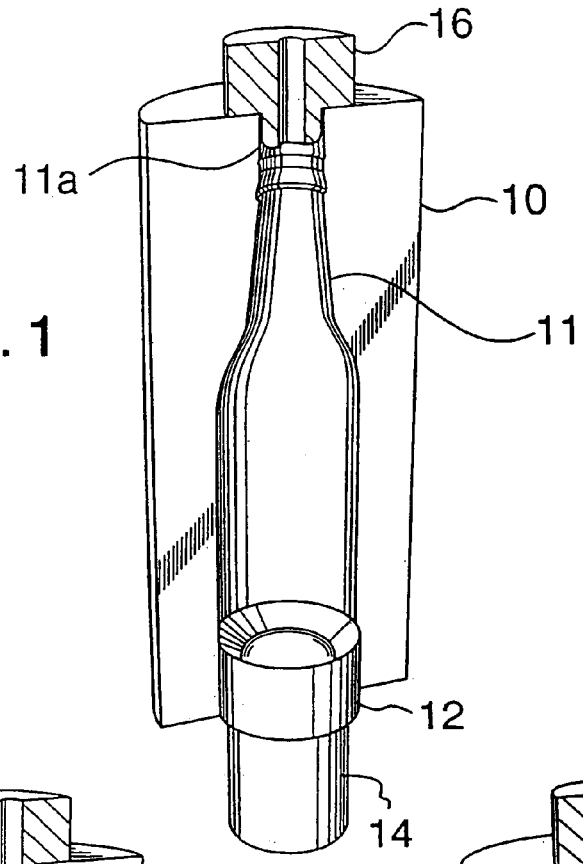
FIG. 1 is a simplified and somewhat schematic perspective view of tooling for performing the method of copending application Ser. No. 10/284,912, in illustrative embodiments.

As illustrated in FIG. 1, the tooling assembly for the method of the invention includes a split die 10 with a profiled cavity 11 defining an axially vertical bottle shape, a punch 12 that has the contour desired for the bottom of the container (for example, as illustrated, a convexly domed contour for imparting a domed shape to the bottom of the formed container) and a ram 14 that is attached to the punch. In FIG. 1, only one of the two halves of the split die is shown, the other being a mirror image of the illustrated die half; as will be apparent, the two halves meet in a plane containing the geometric axis of the bottle shape defined by the wall of the die cavity 11.

The minimum diameter of the die cavity 11, at the upper open end 11*a* thereof (which corresponds to the neck of the bottle shape of the cavity) is equal to the outside diameter of the preform (see FIG. 2A) to be placed in the cavity, with allowance for clearance. The preform is initially positioned slightly above the punch 12 and has a schematically represented pressure fitting 16 at the open end 11*a* to allow for internal pressurization. Pressurization can be achieved, for example, by a coupling to threads formed in the upper open end of the preform, or by inserting a tube into the open end of the preform and making a seal by means of the split die or by some other pressure fitting.

The pressurizing step involves introducing, to the interior of the hollow preform, a fluid such as water or air under pressure sufficient to cause the preform to expand within the cavity until the wall of the preform is pressed substantially fully against the cavity-defining die wall, thereby imparting the shape and lateral dimensions of the cavity to the expanded preform. Stated generally, the fluid employed may be compressible or noncompressible, with any of mass, flux, volume or pressure controlled to control the pressure to which the preform walls are thereby subjected. In selecting the fluid, it is necessary to take into account the temperature conditions to be employed in the forming operation; if water is the fluid, for example, the temperature must be less than 100° C., and if a higher temperature is required, the fluid should be a gas such as air, or a liquid that does not boil at the temperature of the forming operation.

As a result of the pressurizing step, detailed relief features formed in the die wall are reproduced in inverse mirror-image form on the surface of the resultant container. Even if such features, or the overall shape, of the produced container are not axisymmetric, the container is removed from the tooling without difficulty owing to the use of a split die.

Figure 2A:
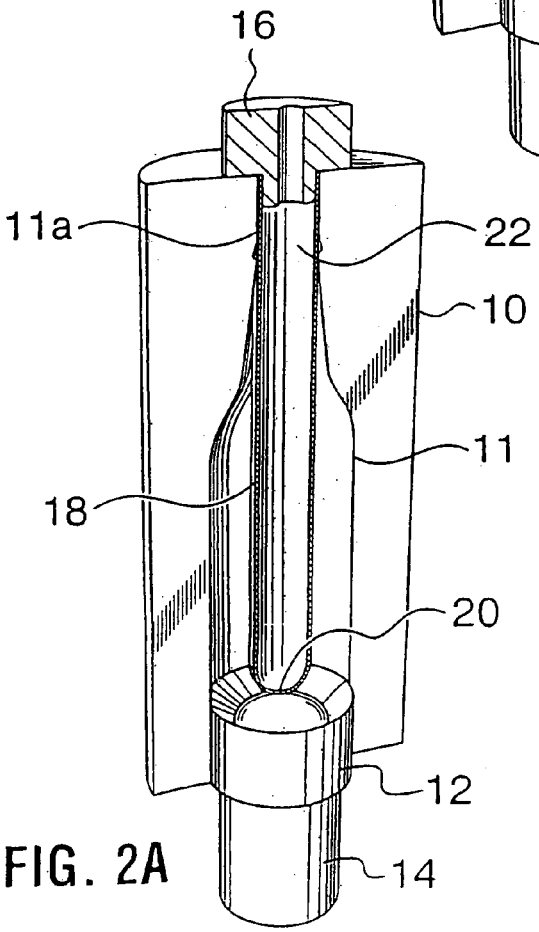
FIGS. 2A and 2B are views similar to FIG. 1 of sequential stages in the performance of a first embodiment of the method of application Ser. No. 10/284,912.
Figure 2B:
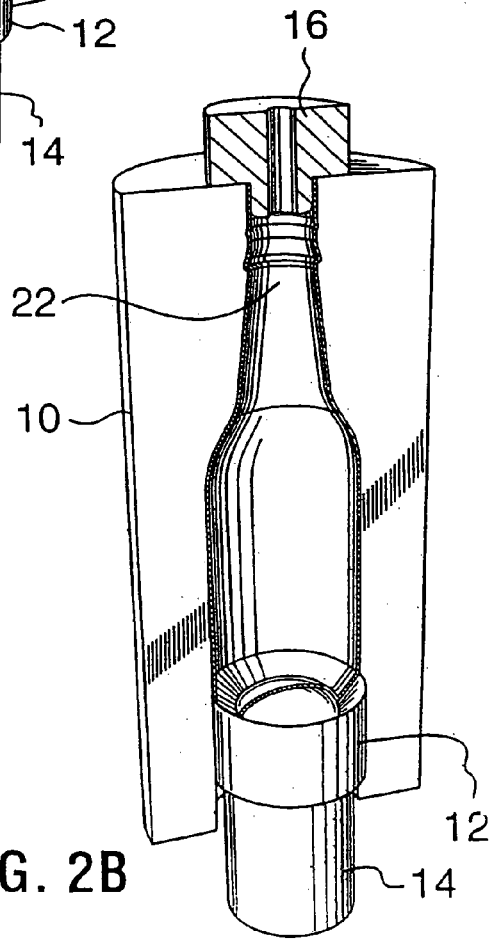

In the specific arrangement illustrated in FIGS. 2A and 2B, the preform 18 is a hollow cylindrical aluminum workpiece with a closed lower end 20 and an open upper end 22, having an outside diameter equal to the outside diameter of the neck of the bottle shape to be formed, and the forming strains of the PRF operation are within the bounds set by the formability of the preform (which depends on temperature and deformation rate). With a preform having this property of formability, the shape of the die cavity 11 is made exactly as required for the final product and the product can be made in a single PRF operation. The motion of the ram 14 and the rate of internal pressurization are such as to minimize the strains of the forming operation and to produce the desired shape of the container. Neck and side-wall features result primarily from the expansion of the preform due to internal pressure, while the shape of the bottom is defined primarily by the motion of the ram and punch 12, and the contour of the punch surface facing the preform closed end 20.

Figure 3:
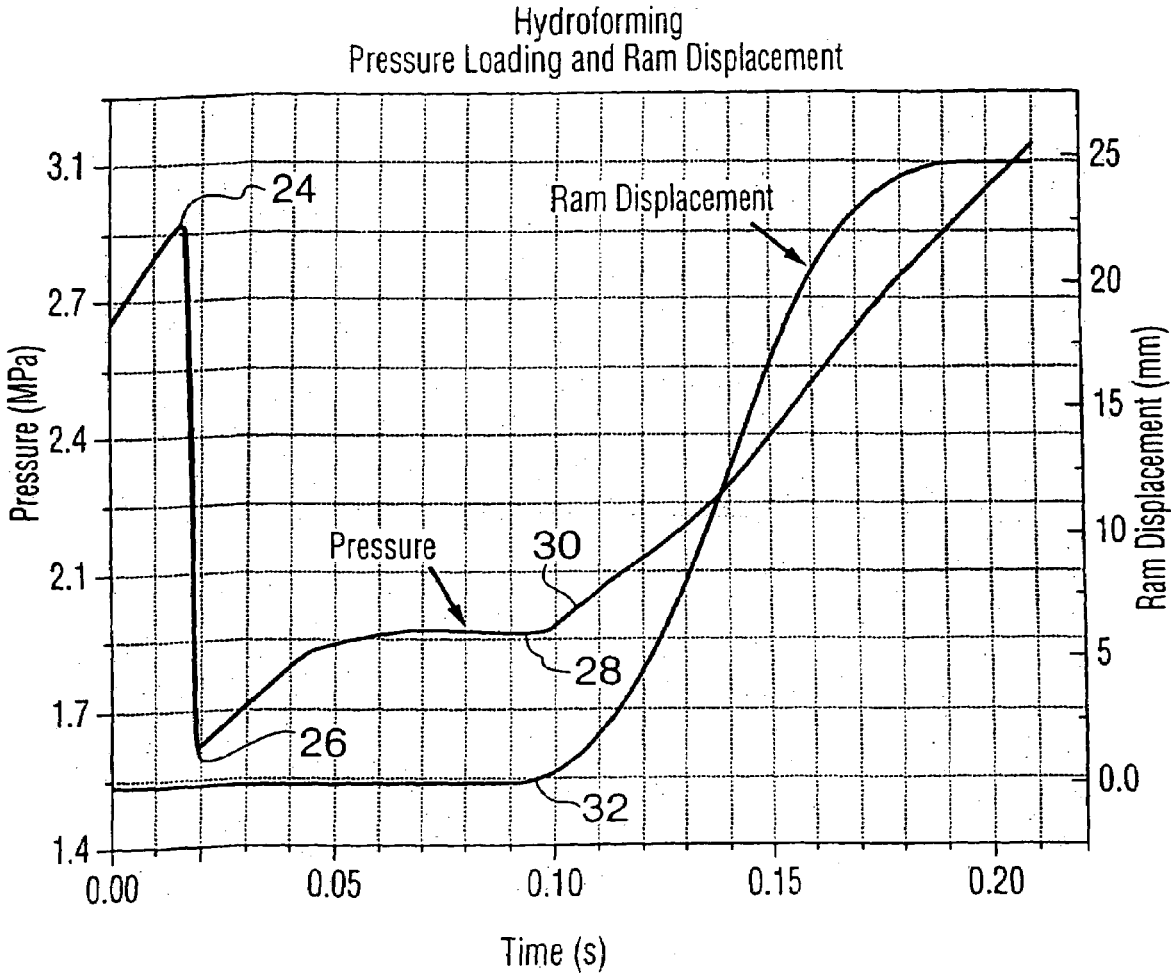
FIG. 3 is a graph of internal pressure and ram displacement as functions of time, using air as the fluid medium, illustrating the time relationship between the steps of subjecting the preform to internal fluid pressure and translating the punch in the method of application Ser. No. 10/284,912.
Figure 4A:
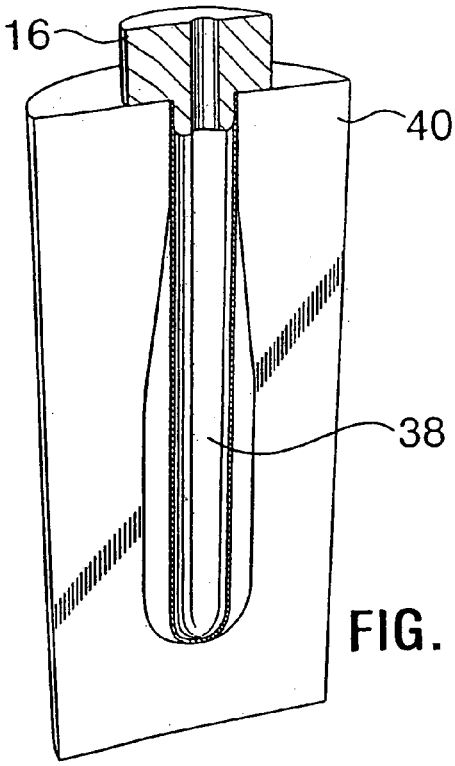
FIGS. 4A, 4B, 4C and 4D are views similar to FIG. 1 of sequential stages in the performance of a second embodiment of the method of application Ser. No. 10/284,912.
Figure 4B:
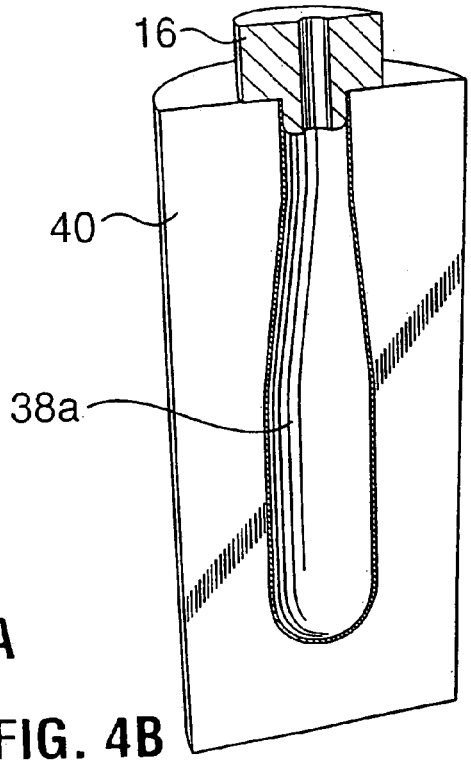
Figure 4C:
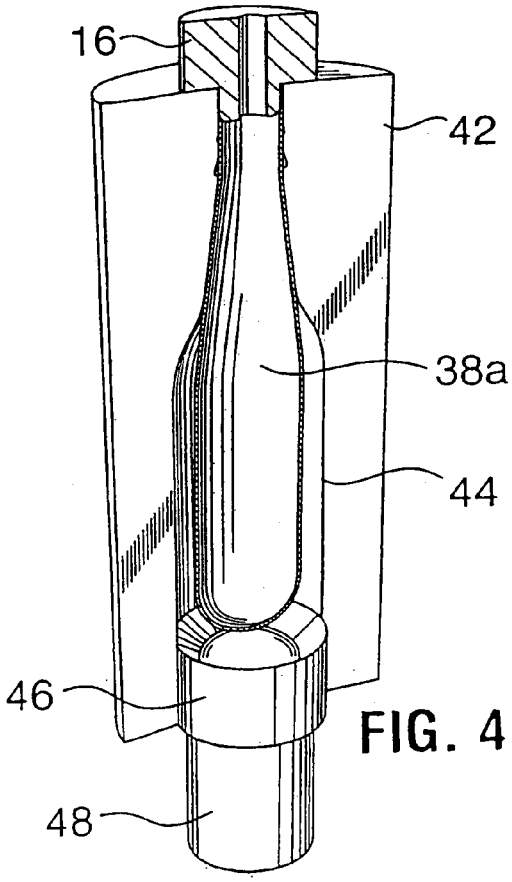
Figure 4D:
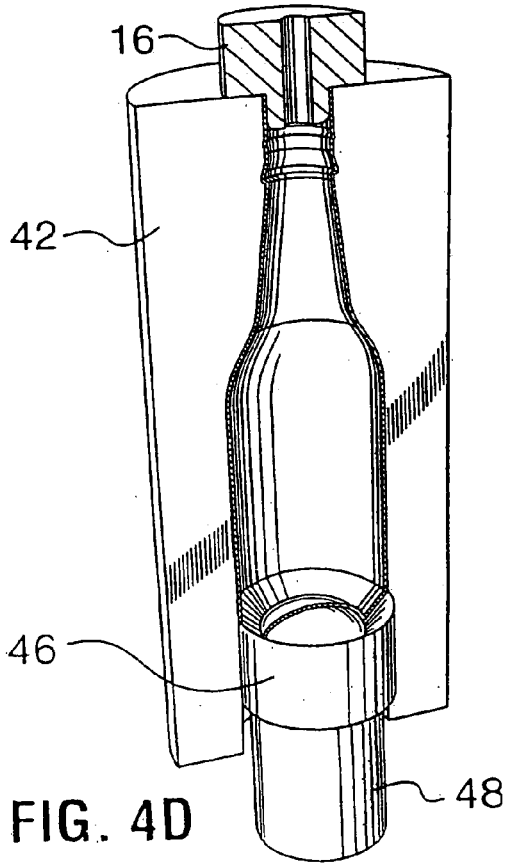

Proper synchronization of the application of internal fluid pressure and operation (translation into the die cavity) of the ram and punch are important in the practice of PRF methods. FIG. 3 shows a plot of computer-generated simulated data (sequence of finite element analysis outputs) representing the forming operation of FIGS. 2A and 2B with air pressure, controlled by flux. Specifically, the graph illustrates the pressure and ram time histories involved. As will be apparent from FIG. 3, the fluid pressure within the preform occurs in successive stages of (i) rising to a first peak 24 before expansion of the preform begins, (ii) dropping to a minimum value 26 as expansion commences, (iii) rising gradually to an intermediate value 28 as expansion proceeds until the preform is in extended though not complete contact with the die wall, and (iv) rising more rapidly (at 30) from the intermediate value during completion of preform expansion. Stated with reference to this sequence of pressure stages, the initiation of translation of the punch to displace and deform the closed end of the preform preferably occurs (at 32) substantially at the end of stage (iii). Time, pressure and ram displacement units are indicated on the graph. The effect of the operations represented in FIG. 3 on the preform (in a computer generated simulation) is shown in FIGS. 6A, 6B, 6C and 6D for times 0.0, 0.096, 0.134 and 0.21 seconds as represented on the x-axis of FIG. 3.

At the outset of introduction of internal fluid pressure to the hollow preform, the punch 12 is disposed beneath the closed end of the preform (assuming an axially vertical orientation of the tooling, as shown) in closely proximate (e.g. touching) relation thereto, so as to limit axial stretching of the preform under the influence of the supplied internal pressure. When expansion of the preform attains a substantial though not fully complete degree, the ram 14 is actuated to forcibly translate the punch upwardly, displacing the metal of the closed end of the preform upwardly and deforming the closed end into the contour of the punch surface, as the lateral expansion of the preform by the internal pressure is completed. The upward displacement of the closed preform end, in these described embodiments, does not move the preform upwardly relative to the die or cause the side wall of the preform to buckle (as might occur by premature upward operation of the ram) owing to the extent of preform expansion that has already occurred when the ram begins to drive the punch upward.

A second embodiment of the PRF method of the aforesaid copending application is illustrated in FIGS. 4A–4D. In this embodiment, as in that of FIGS. 2A and 2B, the cylindrical preform 38 has an initial outside diameter equal to the minimum diameter (neck) of the final product. However, in this embodiment it is assumed that the forming strains of the PRF operation exceed the formability limits of the preform. In this case, two sequential pressure forming operations are required. The first (FIGS. 4A and 4B) does not require a ram and simply expands the preform within a simple split die 40 to a larger diameter workpiece 38*a* by internal pressurization. The second, a PRF procedure (FIGS. 4C and 4D), starts with the workpiece as initially expanded in the die 40 and, employing a split die 42 with a bottle-shaped cavity 44 and a punch 46 driven by a ram 48, i.e., using both internal pressure and the motion of the ram, produces the final desired bottle shape, including all features of the side-wall profile and the contours of the bottom, which are produced primarily by the action of the punch 46.

Figure 5A:
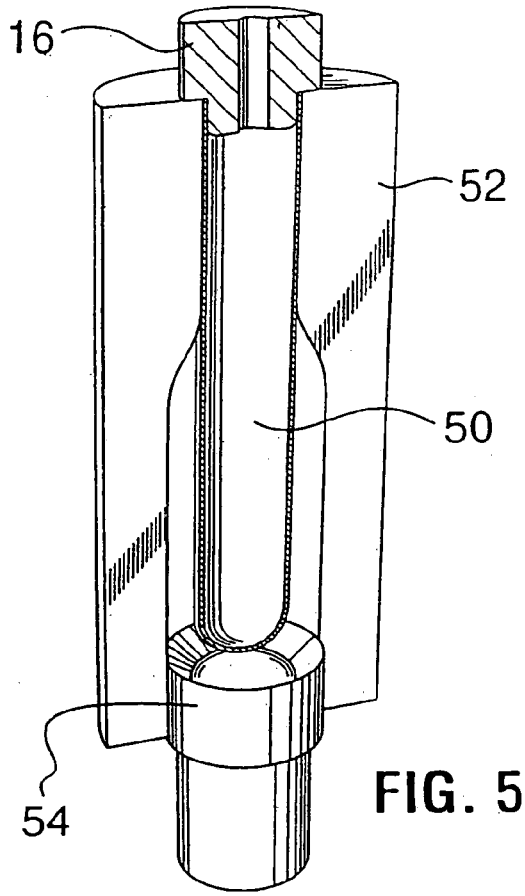
FIGS. 5A and 5B are, respectively, a view similar to FIG. 1 and a simplified, schematic perspective view of a spin-forming step, illustrating sequential stages in the performance of a third embodiment of the method of application Ser. No. 10/284,912.
Figure 5B:
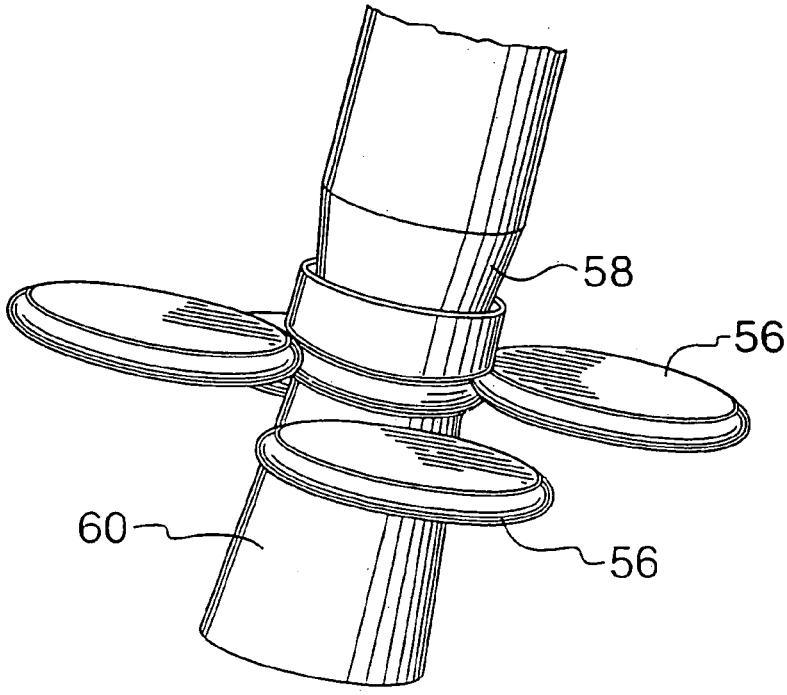

A third embodiment is shown in FIGS. 5A and 5B. In this embodiment, the preform 50 is made with an initial outside diameter that is greater than the desired minimum outside diameter (usually the neck diameter) of the final bottle-shaped container. This choice of preform may result from considerations of the forming limits of the pre-forming operation or may be chosen to reduce the strains in the PRF operation. In consequence, manufacture of the final product must include both diametrical expansion and compression of the preform and thus can not be accomplished with the PRF apparatus alone. A single PRF operation (FIG. 5A, employing split die 52 and ram-driven punch 54) is used to form the wall and bottom profiles (as in the embodiment of FIGS. 2A and 2B) and a spin forming or other necking operation is required to shape the neck of the container. As illustrated in FIG. 5B, one type of spin forming procedure that may be employed is that set forth in U.S. Pat. No. 6,442,988, the entire disclosure of which is incorporated herein by this reference, utilizing plural tandem sets of spin forming discs 56 and a tapered mandrel 58 to shape the bottle neck 60.

In the practice of the PRF procedure described above, PRF strains may be large. Alloy composition is accordingly selected or adjusted to provide a combination of desired product properties and enhanced formability. If still better formability is required, the forming temperature may be adjusted as described hereinafter, since an increase in temperature affords better formability; hence, the PRF operation(s) may need to be conducted at elevated temperatures and/or the preform may require a recovery anneal, in order to increase its formability.

The importance of moving the ram-driven punch 12 into the die cavity 11 to displace and deform the closed end 20 of the preform 18 (as in FIGS. 2A and 2B) may be further explained by reference to FIG. 3 (mentioned above) as considered together with FIGS. 6A–6D, in which the dotted line represents the vertical profile of the die cavity 11, and the displacement (in millimeters) of the dome-contoured punch 12 at various times after the initiation of internal pressure is represented by the scale on the right-hand side of that dotted line.

Figure 6A:
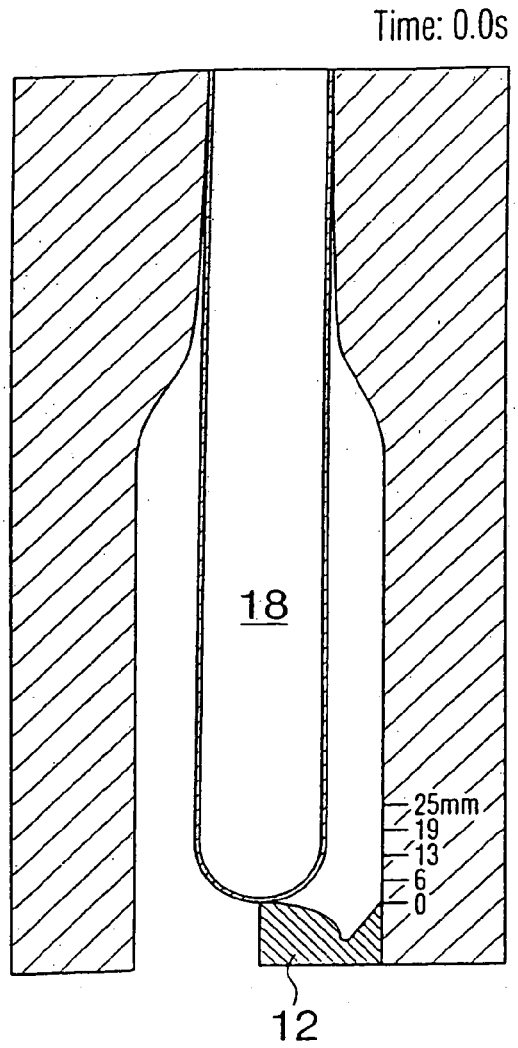
FIGS. 6A, 6B, 6C and 6D are computer-generated schematic elevational views of successive stages in the method of application Ser. No. 10/284,912.
Figure 6B:
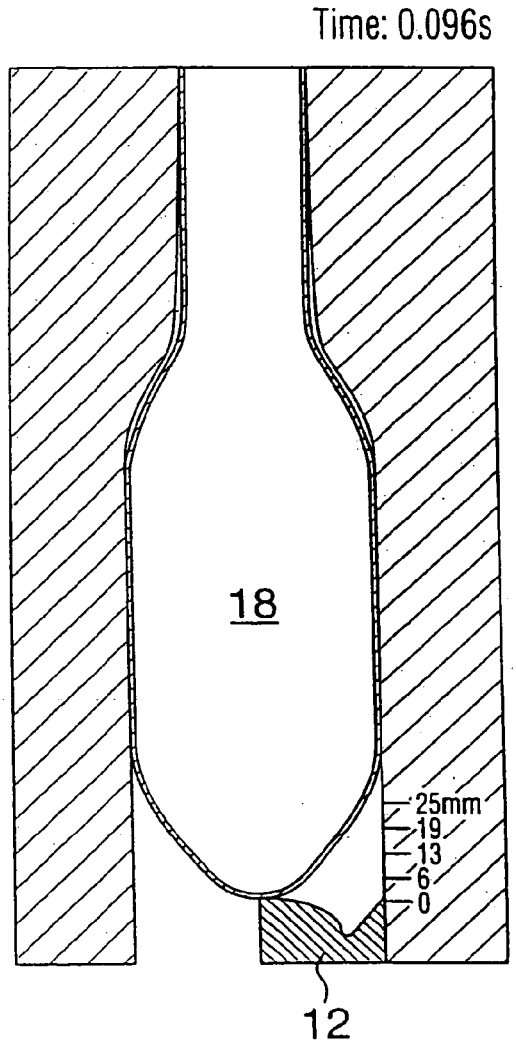
Figure 6C:
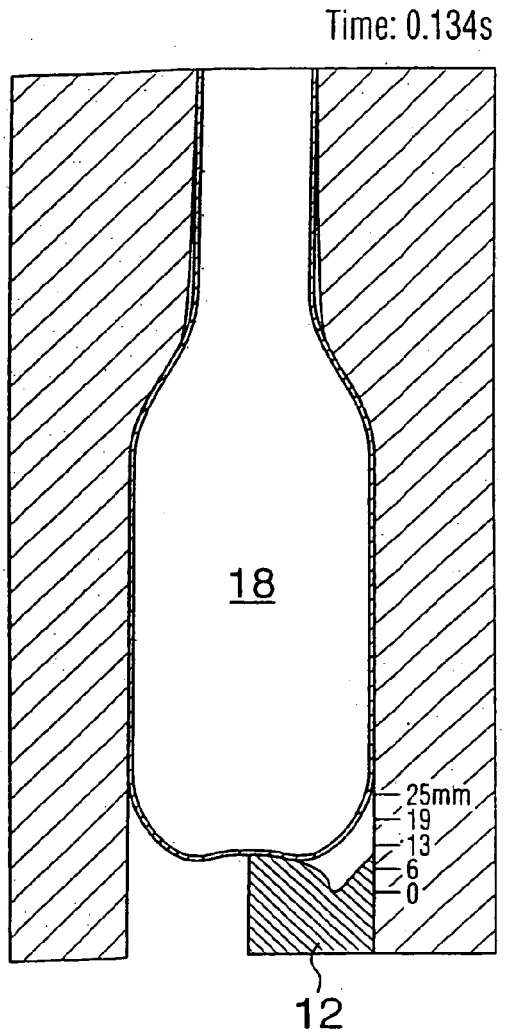
Figure 6D:
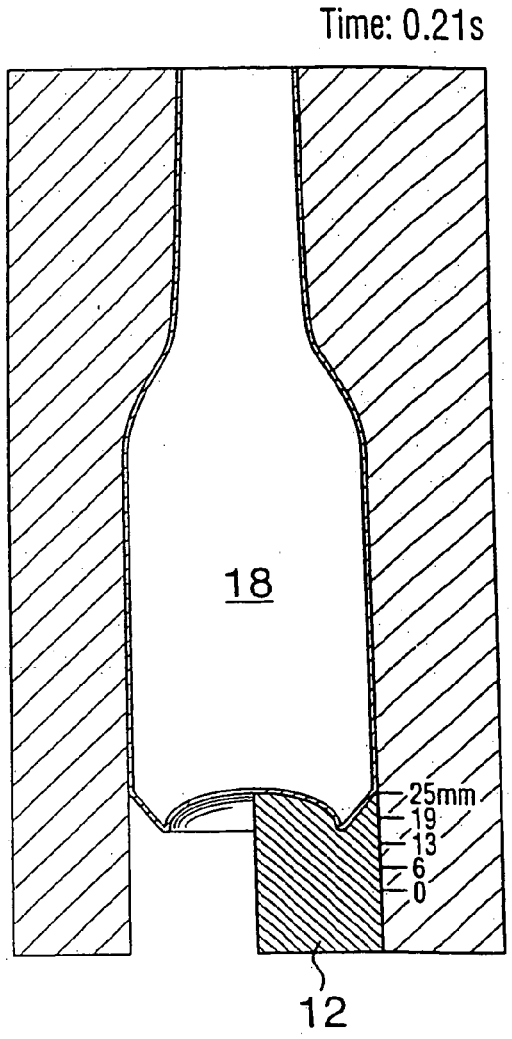

The ram serves two functions in the forming of the aluminum bottle. It limits the axial tensile strains and forms the shape of the bottom of the container. Initially the ram-driven punch 12 is held in close proximity to, or just touching, the bottom of the preform 18 (FIG. 6A). This serves to minimize the axial stretching of the preform side wall that would otherwise occur as a result of internal pressurization. Thus, as the internal pressure is increased, the side wall of the preform will expand to contact the inside of the die without significant lengthening. In these described embodiments, the central region of the preform will typically expand first; this region of expansion will grow along the length of the preform, both upward and downward, and at some point in time the bottom of the preform will become nearly hemispherical in shape, with the radius of the hemisphere approximately equal to that of the die cavity (FIG. 6B). It is at or just before this point in time that the ram must be actuated to drive the punch 12 upwards (FIG. 6C). The profile of the nose of the ram (i.e. the punch surface contour) defines completely the profile of the bottom of the container. As the internal fluid pressure completes the molding of the preform against the die cavity wall (compare the bottle shoulder and neck in FIGS. 6B, 6C and 6D), the motion of the ram, combined with the internal pressure, forces the bottom of the preform into the contours of the punch surface in a manner that produces the desired contour (FIG. 6D) without excessive tensile strains that could, conceivably, lead to failure. The upward motion of the ram applies compressive forces to the hemispherical region of the preform, reduces general strain caused by the pressurizing operation, and assists in feeding material radially outwards to fill the contours of the punch nose.

If the ram motion is applied too early, relative to the rate of internal pressurization, the preform is likely to buckle and fold due to the compressive axial forces. If applied too late, the material will undergo excessive strain in the axial direction causing it to fail. Thus, coordination of the rate of internal pressurization and motion of the ram and punch nose is required for a successful forming operation. The necessary timing is best accomplished by finite element analysis (FEA) of the process. FIG. 3 is based on results of FEA.

The PRF method has been thus far described, and exemplified in FIG. 3, as if no positive (i.e., superatmospheric) fluid pressure were applied to the outside of the preform within the die cavity. In such a case, the external pressure on the preform in the cavity would be substantially ambient atmospheric pressure. As the preform expands, air in the cavity would be driven out (by the progressive diminution of volume between the outside of the preform and the die wall) through a suitable exhaust opening or passage provided for that purpose and communicating between the die cavity and the exterior of the die.

Stated with specific reference to aluminum containers, by way of illustration, it has been shown by FEA that in the absence of any applied positive external pressure, once the preform starts to deform (flow) plastically, the strain rate in the preform becomes very high and is essentially uncontrollable, owing to the low or zero work hardening rate of aluminum alloys at the process temperature (e.g. about 300° C.) of the pressure-ram-forming operation.

That is to say, at such temperatures the work hardening rate of aluminum alloys is essentially zero and ductility (i.e., forming limit) decreases with increasing strain rate. Thus, the ability to make the desired final shaped container product is lessened as the strain rate of the forming operation increases and the ductility of aluminum decreases.

In accordance with a further important feature of the PRF method, positive fluid pressure is applied to the outside of the preform in the die cavity, simultaneously with the application of positive fluid pressure to the inside of the preform. These external and internal positive fluid pressures are respectively provided by two independently controlled pressure systems. The external positive fluid pressure can be conveniently supplied by connecting an independently controllable source of positive fluid pressure to the aforementioned exhaust opening or passage, so as to maintain a positive pressure in the volume between the die and the expanding preform.

Figure 7:
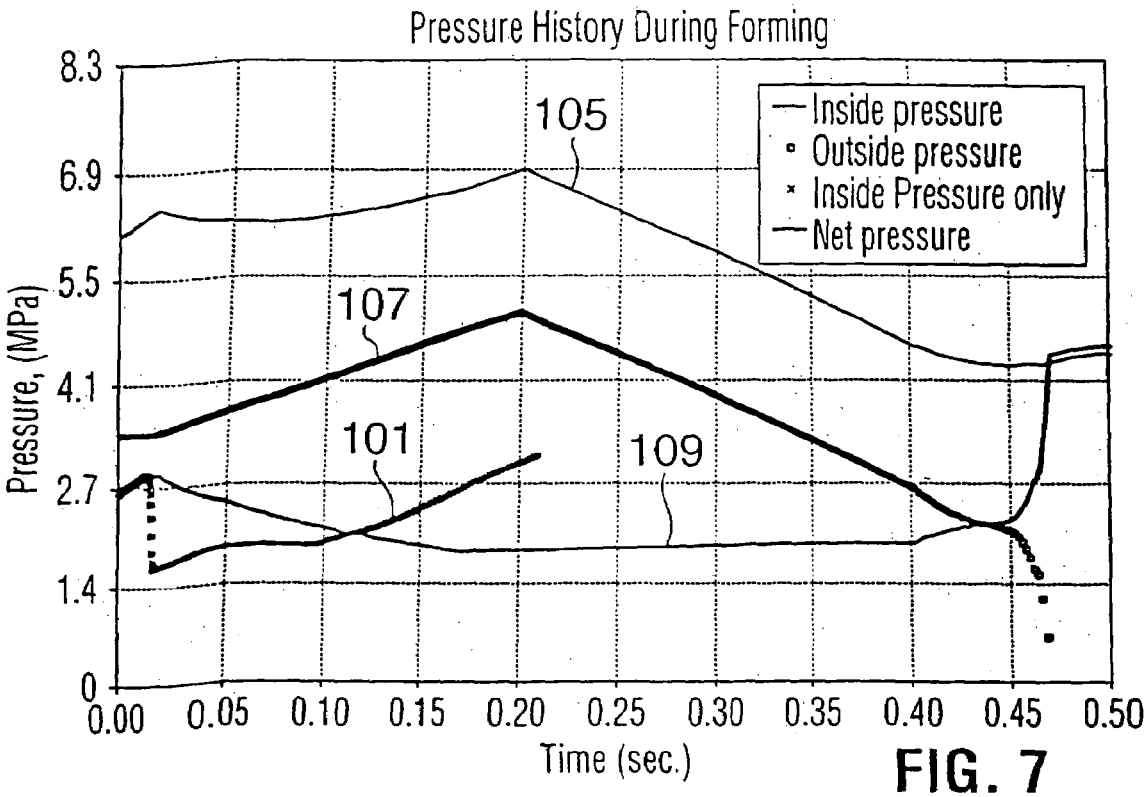
FIG. 7 is a graph of pressure variation over time (using arbitrary time units) illustrating the feature of simultaneously applying independently controllable internal and external positive fluid pressures to the preform in the die cavity and comparing therewith internal pressure variation (as in FIG. 3) in the absence of external positive pressure.
Figure 8:
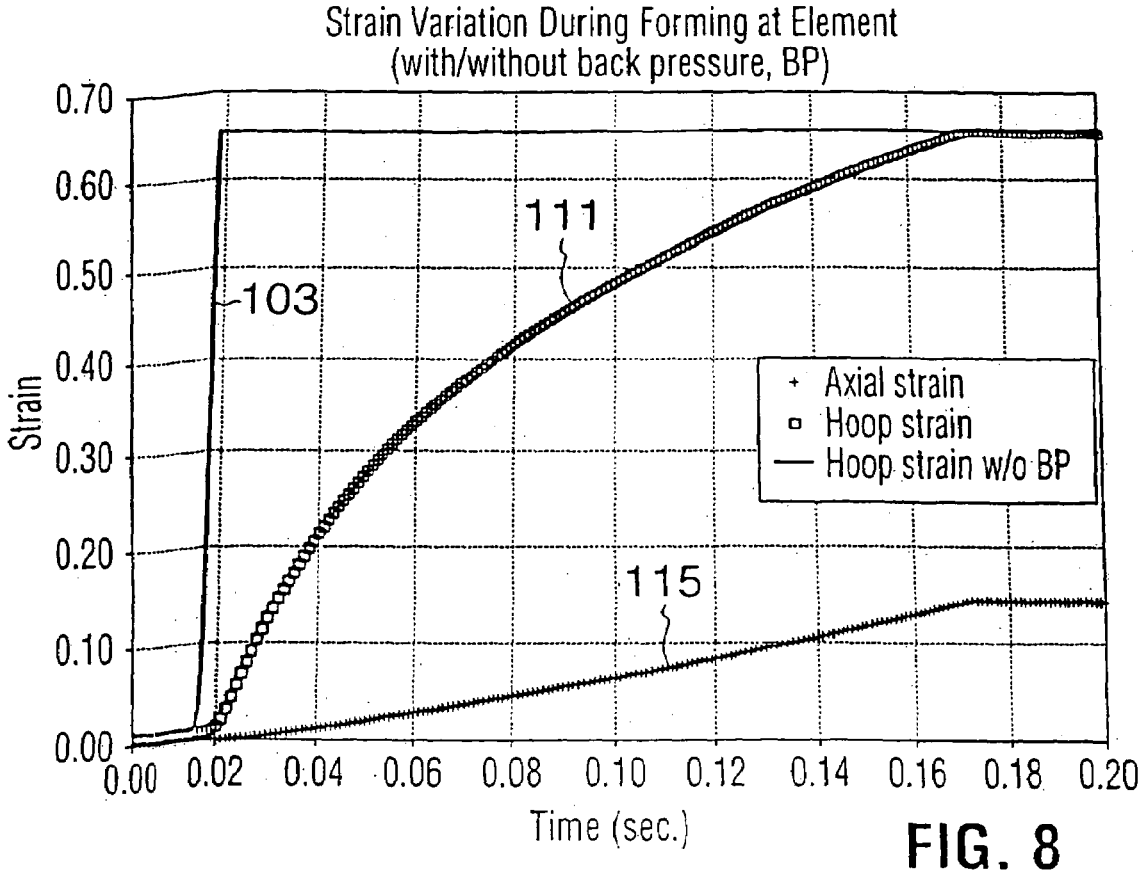
FIG. 8 is a graph of strain variation over time, derived from finite element analysis, showing strain for one particular position (element) under the two different pressure conditions compared in FIG. 7.

FIGS. 7 and 8 compare the pressure vs. time and strain vs. time histories for pressure-ram-forming a container with and without positive external pressure control (the term "strain" herein refers to elongation per unit length produced in a body by an outside force). Line 101 of FIG. 7 corresponds to the line designated "Pressure" in FIG. 3, for the case where there is no external positive fluid pressure acting on the preform; line 103 of FIG. 8 represents the resulting strain for one particular position (element) as determined by FEA. Clearly the strain is almost instantaneous in this case, implying very high strain rates and very short times to expand the preform into contact with the die wall. In contrast, lines 105, 107 and 109 of FIG. 7 respectively represent internal positive fluid pressure, external positive fluid pressure, and the differential between the two, when both internal and external pressures are controlled, i.e., when external and internal positive fluid pressures, independently controlled, are simultaneously applied to the preform in the die cavity; the internal pressure is higher than the external pressure so that there is a net positive internal-external pressure differential as needed to effect expansion of the preform. Line 111 in FIG. 8 represents the hoop strain (strain produced in the horizontal plane around the circumference of the preform as it is expanding) for the independently controlled internal-external pressure condition represented by lines 105, 107 and 109; it will be seen that the hoop strain shown by line 111 reaches the same final value as that of line 103 but over a much longer time and thus at a much lower strain rate. Line 115 in FIG. 8 represents axial strain (strain produced in the vertical direction as the preform lengthens).

By simultaneously providing independently controllable internal and external positive fluid pressures acting on the preform in the die cavity, and varying the difference between these internal and external pressures, the forming operation remains completely in control, avoiding very high and uncontrollable strain rates. The ductility of the preform, and thus the forming limit of the operation, is increased for two reasons. First, decreasing the strain rate of the forming operation increases the inherent ductility of the aluminum alloy. Second, the addition of external positive pressure decreases (and potentially could make negative) the hydrostatic stress in the wall of the expanding preform. This could reduce the detrimental effect of damage associated with microvoids and intermetallic particles in the metal. The term "hydrostatic stress" herein refers to the arithmetic average of three normal stresses in the x, y and z directions.

The feature thus described enhances the ability of the pressure-ram-forming operation to successfully make aluminum containers in bottle shapes and the like, by enabling control of the strain rate of the forming operation and by decreasing the hydrostatic stress in the metal during forming.

The selection of pressure differential is based on the material properties of the metal from which the preform is made. Specifically, the yield stress and the work-hardening rate of the metal must be considered. In order for the preform to flow plastically (i.e., inelastically), the pressure differential must be such that the effective (Mises) stress in the preform exceeds the yield stress. If there is a positive work-hardening rate, a fixed applied effective stress (from the pressure) in excess of the yield stress would cause the metal to deform to a stress level equal to that applied effective stress. At that point the deformation rate would approach zero. In the case of a very low or zero work-hardening rate, the metal would deform at a high strain rate until it either came into contact with the wall of the mold (die) or fracture occurred. At the elevated temperatures anticipated for the PRF process, the work-hardening rate of aluminum alloys is low to zero.

Examples of gases suitable for use to supply both the internal and external pressures include, without limitation, nitrogen, air and argon, and any combinations of these gases.

The plastic strain rate at any point in the wall of the preform, at any point in time, depends only on the instantaneous effective stress, which in turn depends only on the pressure differential. The choice of external pressure is dependent on the internal pressure, with the overall principle to achieve and control the effective stress, and thus the strain rate, in the wall of the preform.

Figure 9:
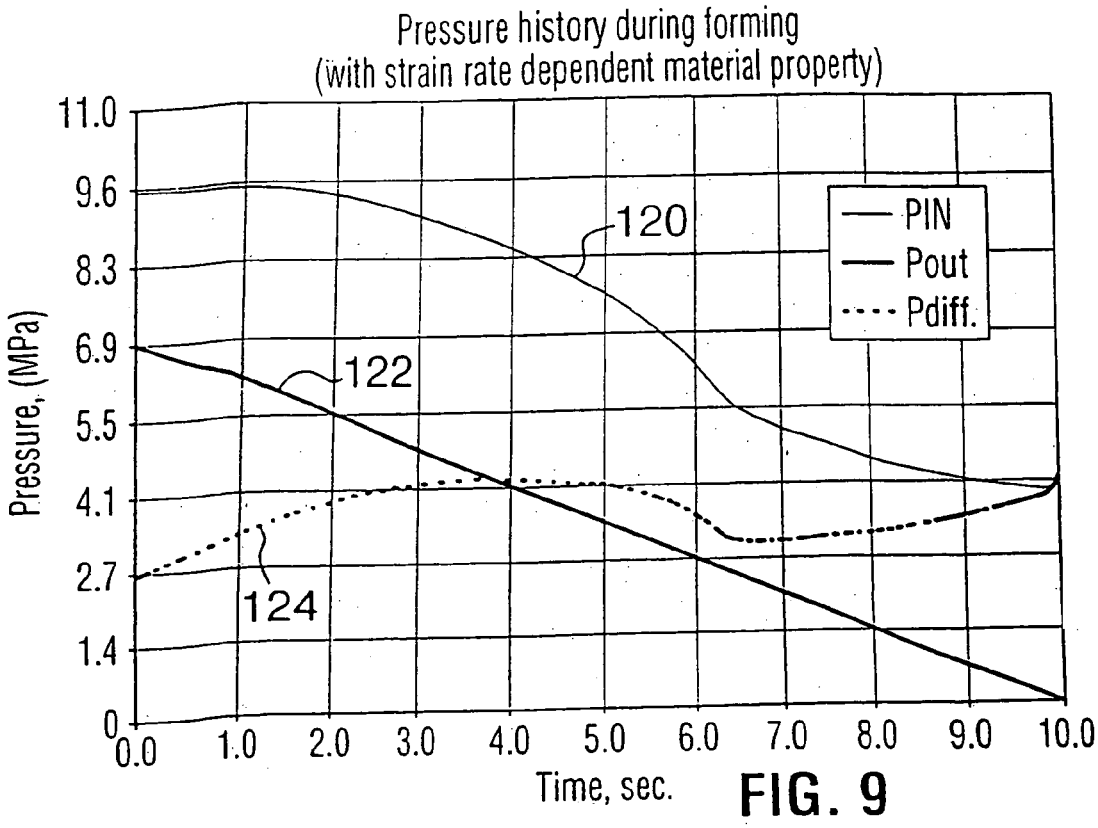
FIG. 9 is a graph similar to FIG. 7 illustrating a particular control mechanism that can be used in the forming process when internal and external positive fluid pressures are simultaneously applied to the preform in the die cavity.

FIG. 9 shows a different control mechanism that can be used in the forming process. Finite element simulations have been used to optimize the process. In FIG. 9, line 120 represents internal pressure (Pin) acting on the preform, line 122 represents external pressure (Pout) acting on the preform, and line 124 represents the pressure differential (Pdiff=Pin−Pout). This figure shows the pressure history from one control method. In this case, the fluid mass in the internal cavity is kept constant and the pressure in the external cavity (outside the preform) is decreasing linearly. Strain rate-dependent material properties are also included in the simulation. This latter control mechanism is currently preferred because it results in a simpler process.

Figure 10:
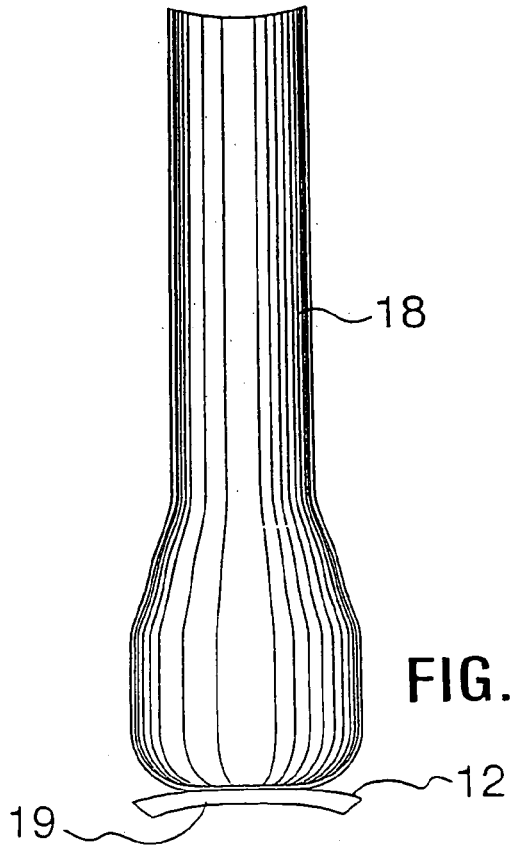
FIG. 10 is a schematic illustration of an expanding preform using a heated punch.

FIG. 10 relates to a PFR method where heating is applied to the preform which induces a temperature gradient to the preform. As shown in FIG. 10, the punch 12 is in contact with the bottom of the preform 18 and the punch 12 contains a heating element 19. This heats the preform from the bottom up causing the expansion of the preform to grow from the bottom up when internal pressure is increased.

Figure 11:
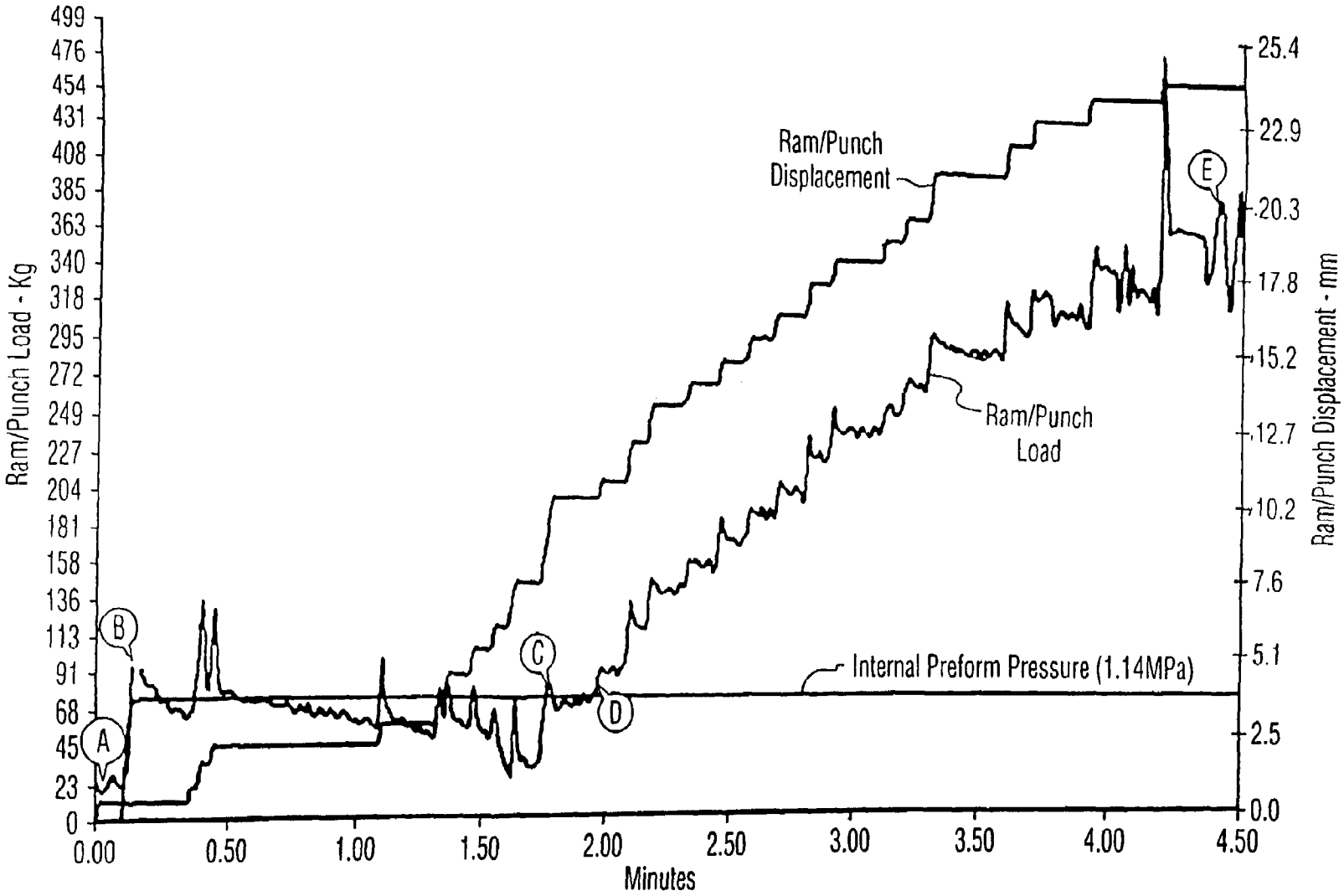
FIG. 11 is a graph showing loadings on the punch, internal pressures and displacements of the punch during expansion of a preform.

FIG. 11 shows graphs illustrating the expansion process. One line of the graph shows the displacements of the ram/punch while the other shows the variations in the load on the ram/punch, both as a function of time. A third line shows the internal pressure in the preform.

At point A the ram is pre-loaded to a compressive load of about 22.7 kg and at point B the preform is internally pressurized and held at a level of 1.14 MPa. In the procedure illustrated, the position of the ram was stepped between points B and C to maintain a compressive ram load of 68 kg. When the ram load no longer decreased rapidly after an increment in ram position (point C to D), the ramping of the ram was continued to a displacement of about 25 mm and a load of about 454 kg (point E). During the ramping of the ram from point D to point E, the bottom profile of the container was formed simultaneously with the expansion of the preform so that point E represents the completion of the forming of the container.

While the graph of FIG. 11 shows a stepwise procedure, it is also possible to expand and form the preform into a container in one smooth operation, e.g. by utilizing a computerized control of the procedure. The advantage of this procedure is that due to the induced temperature gradient, the expansion proceeds gradually from the bottom to the top as the ram and punch move up. It has been shown that this technique leads to reduced improved formability when compared to the previously described methods in which expansion occurs essentially simultaneously over the entire length of the preform.

While FIG. 10 shows a heating element only within the punch 12, it is possible to provide different heating zones to aid in the forming. For instance, there can be a further separate heater around the top of the preform as well as further separate heating elements within the side walls of the die cavity. By independently manipulating the temperatures in each of these areas, optimal expansion histories are developed for various container designs.

Figure 12:
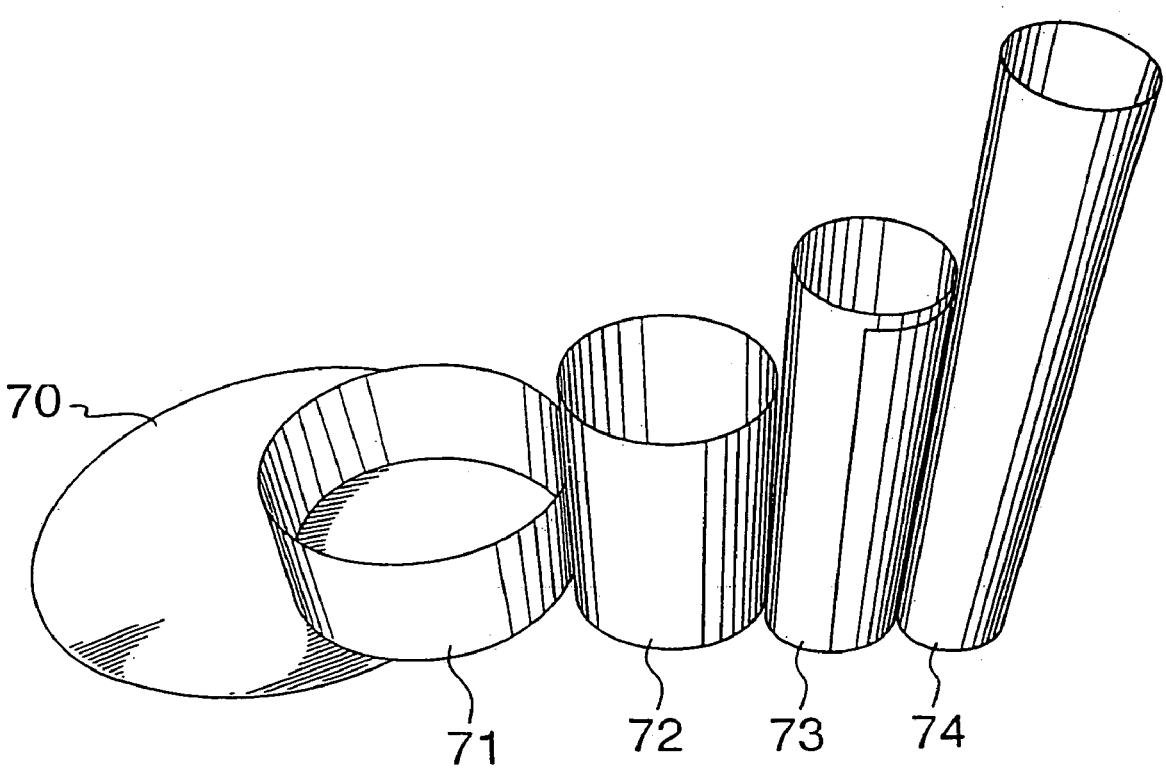
FIG. 12 is a perspective view showing stages in the production of a preform from a flat disc.

FIG. 12 shows a typical sequence in the making of a preform from a flat disc. A standard draw/redraw technique is used with the aluminum sheet 70 being first drawn into a shallow closed end cylinder 71, which is then redrawn into a second cylinder 72 of smaller diameter and longer side wall. Cylinder 72 is then redrawn to form cylinder 73, which is redrawn to form cylinder 74. It will be noted that the cylinder 74 has a long thin configuration.

An embodiment of the PRF apparatus of the copending application, for performance of certain embodiments of the PRF method to form a metal container, is illustrated in FIGS. 13–16. This apparatus includes a split die 210 with a profiled cavity 211 defining an axially vertical bottle shape, a punch 212 contoured to impart a desired container bottom configuration (which may be asymmetric), a backing ram 214 for moving the punch, and a sealing ram 216 for sealing the open upper end of the die cavity and of a metal (e.g. aluminum) container preform 218 when the preform is inserted within the cavity as shown in FIG. 13, as well as additional components and instrumentalities described below.

In the split die of the apparatus of FIGS. 13–16, interchangeable primary inserts 219 and secondary profile sections or inserts 221 and 223 fit onto the inner surface of a split insert holder 225 received in the split main die member 210. These sections can serve as stencils, having inner surfaces formed with relief patterns (the term "relief" being used herein to refer to both positive and negative relief) for applying decoration or embossing to the metal container as it is being formed. Each insert 219, 221 and 223 is itself a split insert, formed in two separate pieces (219*a*, 219*b;* 221*a*, 221*b;* 223*a*, 223*b*) that are respectively fitted in the two separate split insert holder halves 225*a*, 225*b*, which are in turn respectively received in axially vertical facing semi-cylindrical channels of the two split main die member halves 210*a*, 210*b*.

Gas is fed to the die through two separate channels for both internal and external pressurization of the preform. The supply of gas to the interior of the die cavity externally of the preform may be effected through mating ports in the die structure 210 and insert holder 225, from which there is an opening or channel to the cavity interior (for example) through an insert 219, 221 or 223; such an opening or channel will produce a surface feature on the formed container, and accordingly is positioned and configured to be unobtrusive, e.g. to constitute a part of the container surface design. Two groups of heating elements 227 and 229 under independent temperature control may be respectively incorporated in the upper and lower portions of the die, to provide a controlled temperature gradient during operation. A heating element 231 is mounted inside the preform, coaxially therewith; this heating element can eliminate any need to preheat the gas that is supplied to the interior of the preform to expand the preform. Another heating element 233 is provided for the backing ram 214 (thereby serving as a means for heating the punch), with a temperature isolation ring 235 to prevent overheating of the hydraulics and load cells located in adjacent portions of the equipment.

The foregoing features of the apparatus of FIGS. 13–16 enable enhanced rapidity of die changes, reduced energy costs and increased production rates. Desirably, for economy of construction and operation, the only heating elements provided and used may be the coaxial element 231 and the backing ram element 233.

As is additionally illustrated in the apparatus of FIGS. 13–16, screw threads or lugs (to enable attachment of a screw closure cap) and/or a neck ring can be formed in a neck portion of the container during and as a part of the PRF procedure itself, rather than by a separate necking step, again for the sake of increasing production rates. This is accomplished by creating a negative thread or lug pattern in the inner surface portion of the split die corresponding to the neck of the formed container, so that as the preform expands (in the neck region of the die cavity) the thread or lug relief pattern is imparted thereto. For such thread-forming operation, the preform (or at least its neck portion) is dimensioned to be smaller in diameter than the neck of the final formed container.

Figure 15A:
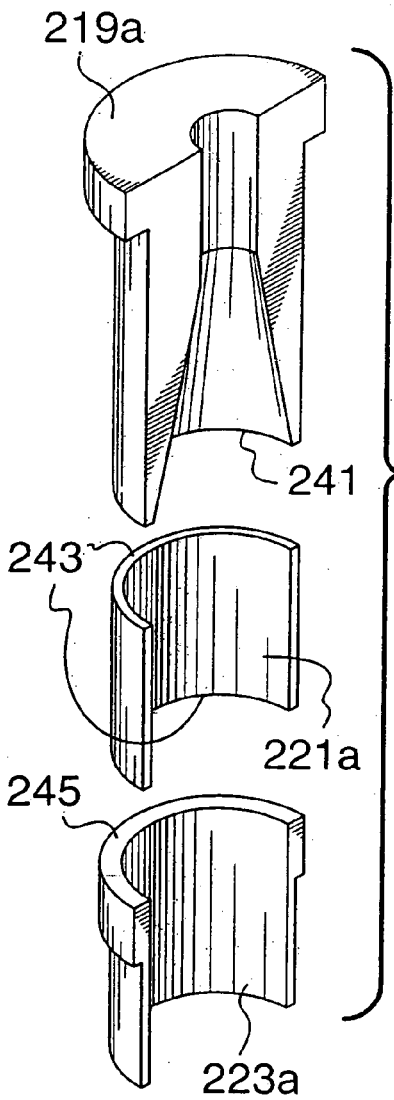
FIGS. 15A, 15B and 15C are perspective views of one half of the split die of the apparatus of FIGS. 13 and 14 respectively illustrating the split inserts of the split die half in exploded view, the split insert holder, and the inserts and holder in assembled relation.
Figure 15B:
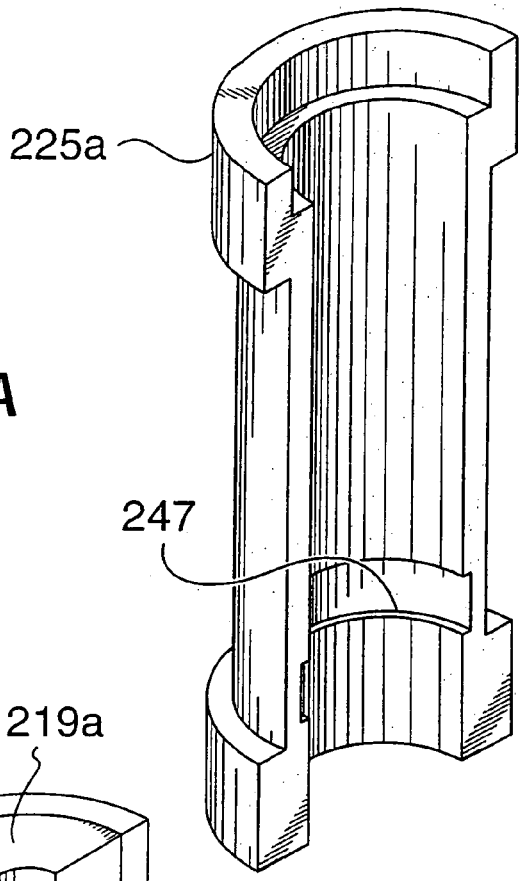
Figure 15C:
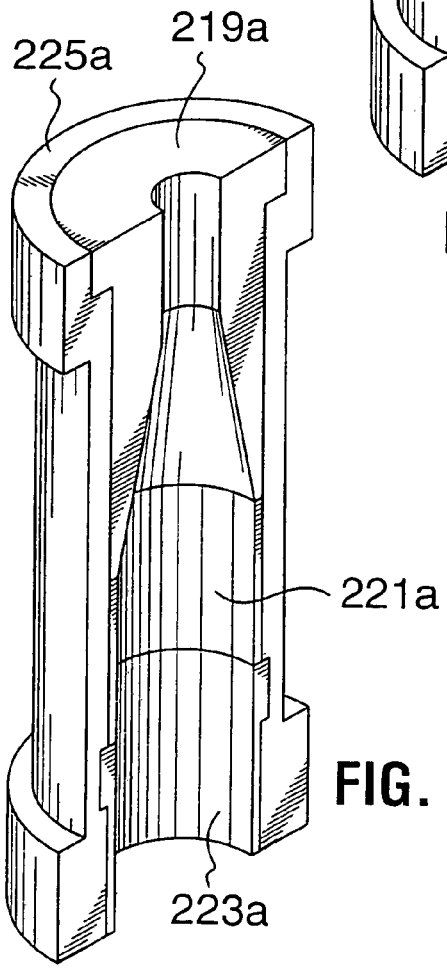

Stated with particular reference to FIGS. 14–16, the insert holder is constituted of two mirror-image halves 225*a*, 225*b* each having an axially vertical and generally semi-cylindrical inner surface. The primary insert 219 and the two secondary split inserts 221 and 223 are disposed in contiguous, tandem succession along the axis of the die cavity, each half of each secondary insert being fitted into one half of the split insert holder so that, when the two halves of the insert holder are brought together in facing relation, the two halves of each split insert are in facing register with each other. The primary and secondary inserts mate with each other at their horizontal edges 241, 243, 245 and have outer surfaces that interfit with features such as ledges 247 formed in the inner surfaces of the halves of the split insert holder. Together, the inserts constitute the entire die wall defining the shape of the container to be formed.

Each of the primary profile insert halves 219*a* and 219*b* has an inner surface defining half of the upper portion, including the neck, of the desired container shape, such as a bottle shape. As indicated at 237 in FIG. 13, the neck-forming surface of each half of this primary split insert (in the illustrated embodiment) is contoured as a screw thread for imparting a cap-engaging screw thread to the neck of the formed container. The remainder of the inner surface of the primary split insert may be smooth, to produce a smooth-surfaced container, or textured to produce a container with a desired surface roughness or repeat pattern.

One or both halves of either or both of the two (upper and lower) secondary profile inserts 221 and 223 may have an inner surface configured to provide positive and/or negative relief patterns, designs, symbols and/or lettering on the surface of the formed container. Advantageously, multiple sets of interchangeable inserts are provided, e.g. with surface features differing from each other, for use in producing formed metal containers with correspondingly different designs or surfaces. Tooling changes can then be effected very rapidly and simply by slipping one set of inserts out of the insert holders and substituting another set of inserts that is interchangeable therewith.

Sealing between opposite components of the split die is accomplished by precision machining that eliminates the need for gaskets and rings.

In the apparatus shown, the split die member 210 is heated by twelve rod heaters 249, each half the vertical height of the die set, inserted vertically in the die assembly from the top and bottom, respectively. Heating control is provided in two zones, upper and lower, with independent temperature control systems (not shown) allowing the temperature gradient in the die to be controlled.

The gas for internal and external pressurization of the preform within the die cavity can be preheated by passing through two separate channels in the two component pressure containment blocks (split die member 210). The channel for external pressurization vents into the die cavity, while the channel for internal pressurization vents to the interior of the preform via the sealing ram 216, to which gas is delivered through sealing ram gas port 250.

The heating element 231 is a heater rod or bayonet attached to the sealing ram and located coaxially with the preform, extending downwardly into the preform, near to the bottom thereof, through the open upper end of the preform, when the sealing ram is in its fully lowered position for performance of a PRF procedure. Element 231 has its own separate temperature control system (not shown). With this arrangement, preheating of the gas may be avoided, enabling elimination of gas preheating equipment and also at least largely avoiding the need to preheat the die components, since only the preform itself needs to be at an elevated temperature. The sealing ram, like the backing ram, is provided with a ceramic temperature isolation ring 253 to prevent overheating of adjacent hydraulics and load cells.

As further shown in FIGS. 13 and 16, the apparatus is also provided with a hydraulic sealing ram adapter 255 and a hydraulic backing ram adapter 257; an isolation ring-sealing ram adapter 259; sealing ram ring 261; and upper and lower pressure containment end caps 263 for each half of the split main die member 210.

A cam system could be used as an alternative to hydraulics for moving the rams.

Process Optimization and Computer Control

As employed with pressure-ram-forming processes and apparatus of the types described above and in the aforementioned copending application, the present invention in a first aspect is directed to methods for the optimization of boundary conditions and computer control of the forming process. PRF and conventional hydroforming operations require the combined action of pressure and motion of tooling to expand a preform into a desired shape. With current technology, all such operations are computer-controlled, in that the pressure-time history and mechanical motion of tooling are specified.

To minimize process (cycle) time and to ensure desired product properties requires optimization of the process. Currently, the boundary conditions, P(t), for a hydroforming or PRF type of operation are determined by experimentation and experience. There is no guarantee that such conditions are optimum so as to produce a product in the minimum cycle time.

The present invention involves optimizing the boundary conditions for a process by finite element analysis (FEA) and transferring the output from the FEA (specifically, the pressure-time history) to the control logic of a laboratory or shop-floor machine. Stated more broadly, it uses FEA to optimize a process, with output from the analysis being transferred to control a machine.

The invention in this first aspect is concerned with defining an optimum pressure-time history and providing feedback from the tooling to the process-control computer. That is to say, the invention provides an optimum definition of process variables in hydroforming operations such as PRF through the definition of a pressure-time history that will ensure that a given critical condition is not exceeded and by providing "real-time" feedback, via die-wall sensors, to the computer control of the forming process.

Thus, in this aspect, the invention generally provides a way of decreasing cycle time of the PRF process, while ensuring acceptable product properties and avoiding failures. It does this by "finite element modeling" the process to establish a pressure-time history that will optimize the forming operation and apply failure limits to selected variables such as minimum wall thickness or maximum strain rate, i.e. by using finite element analysis (FEA) to define an optimum pressure-time history that can then be transferred to the control of a machine, such as the PRF apparatus, and by incorporating thermocouple and/or continuity sensors into the die wall and connecting them via feedback loops to the computer system controlling the forming process so as to provide active feedback from a die set to the computer control of the PRF process.

The finite element modeling requires a finite element analysis of the forming process that has material constitutive equations that reliably predict the temperature and strain-rate dependencies of plastic deformation. A finite element analysis is performed in order to define the pressure-time history that will optimize the forming operation; for this, a definition of a failure criterion must be specified. Examples of such a criterion include a minimum wall thickness, a maximum strain component and a maximum strain rate, beyond which workpiece failure may occur. The active probes (thermocouple and continuity) imbedded in the die wall provide feedback to the computer control loop on the state of the forming operation.

As described above, the PRF process forms a container from sheet using a combination of internal pressure and the motion of a ram to produce a container from rolled sheet. It is a two-step process: first, a preform is made from sheet using more-or-less conventional stamping or deep-drawing technology; and second, the preform is subjected to internal pressure at elevated temperatures to force the preform to expand into a die set. A split die and a movable ram or punch contain the expanding preform and impart the desired shape to it after expansion into the die set. The preform is forced, by internal pressure and motion of the ram, to flow over the contour of the ram.

In the PRF operation, the ram initially prevents a "blow-out" (or bulge test) type of failure as the preform is forced to expand into the die by the internal pressure. Secondly, the ram completes the final shape of the product. It is thus essential to know when to "push" the ram to form the details of the bottom of the container being formed.

Control of internal pressure is a critical variable for preventing a "blow-out" failure and for minimizing cycle time, both of which are crucial for commercial applications of the two processes. Knowing when to close the die set by moving the ram is also important. This invention addresses pressure control and timing of ram movement through the use of computer FEA simulation to optimize the pressure-time history of the operation and the introduction of a new sensor to detect when the expanding preform moves past a given position on the die wall.

The control software used to control the PRF process allows the operator to combine multiple steps of "ramp" or "hold" for both the internal pressure (and optionally the external pressure) and the ram position during the PRF process. The stress in the wall of the expanding container increases rapidly (for a fixed internal pressure) as the preform expands. Thus the strain rate in the wall depends on the internal pressure, the "diameter" of the expanded preform and on temperature. The ductility, or alternatively the failure strain, of the preform depends sensitively on strain rate and temperature. Thus, control of the maximum strain rate at all times during the PRF process is essential. An optimum (minimum) cycle time can only be achieved by control of pressure to maximize the expansion rate of the preform while maintaining the ductility of the preform so as to allow the preform to reach the die walls without failure.

Stated with reference to the use of strain rate as a failure criterion, PRF process optimization involves determining the pressure profile that will minimize process (cycle) time while maintaining the strain rate low enough, at each location in the preform, so that failure does not occur. The strain rate depends not only on temperature and pressure but also on the degree of expansion and thus wall-thinning. Unlike conventional FEA, which enables a pre-defined, time dependent pressure profile to be imposed as a boundary condition and then enables the expansion of the preform to be calculated for a given temperature profile in it, PRF process optimization requires a calculation of the pressure-time history that would give the minimum time to complete a PRF operation within the constraints of ductility (and failure) that are temperature and strain-rate dependent.

That is to say, to calculate the boundary conditions that will produce a product in a minimum time, for PRF, it is necessary to know the internal pressure-time history that will form a product in a minimum time without failure. To do so, it is necessary to assume that the limit strains, as a function of temperature and strain rate, are known. Tensile test data as a function of temperature and strain rate can provide a first estimate. Elliptical bulge and plane-strain tension test data (at elevated temperatures) are better, as PRF processes have strain paths that can be simulated by such tests. To a good first approximation, this simply means that the process must not exceed a given maximum strain rate (which depends on temperature) at each location in the wall of the preform as it expands into the die. Then, it is necessary to define the pressure-time history that will accomplish the objective.

The problem to be solved is to determine the maximum pressure that can be applied, at any time along the process route, without causing failure. The output of such analysis is a profile of the internal pressure as a function of time, given process temperature and material properties (without knowledge of the temperature and strain rate dependencies of the plasticity of the material from which the preform is made, the analysis would be of little or no use).

As the objective is to define a pressure-time history that does not cause a plastic strain rate in excess of a given value, one might choose ten increments in time from start to finish and calculate the pressure for each increment as follows: For each increment, one calculates the maximum pressure that can be applied without causing failure. To do so requires a series of conventional finite element analyses, with an increasing pressure for each. The maximum pressure so obtained, before failure, becomes one point on the pressure-time plot. The deformed mesh and "state variables" of the metal from this step become the initial conditions for the next step, which again imposes a set of pressure conditions and determines the limit (failure) strain. By this procedure, a plot of pressure vs. time that optimizes the process and minimizes the cycle time is obtained. This P(t) curve can then be applied to an actual PRF process. FIG. 17 is a conceptual flow chart of the optimization method.

FIG. 18A plots the evolution of circumferential strain and thickness strain of one element as the element moves radially outward under the action of the internal pressure and ram force. The plastic strain rate for the element is shown in FIG. 18B. If it is assumed that failure occurs when a critical strain rate (as indicated by the horizontal line) is exceeded, it is evident that "failure" would have occurred at approximately 18.6 s.

In the FEA, there is a search through all elements, at each time increment, to determine when a failure would occur. Upon finding such a point, one would back off 2 or 3 increments in process time and resume FEA of the process at a lower pressure from the "state" at the new, starting process time. The stored value would later be used for control of the actual process.

Important are appropriate constitutive equations, that capture the temperature and strain rate sensitivities of the flow stress of the sheet, and experimental evaluation of forming limits, at appropriate temperatures, strain rates and strain paths.

The temperature gradient, imposed on the preform before the pressure to cause expansion to the die wall is applied, ensures that the process proceeds from the hot to cooler end of the preform (or in any desired pattern depending on the gradient imposed). As a further feature of the invention, continuity probes imbedded in the wall of the die can track the advancing interface. An example of such a probe, designated 300, is shown in FIGS. 19, 20 and 21. It is made of fine wire 301, concentrically surrounded by a ceramic sealing agent 302 and a ceramic tube 303, and is located through the die wall 304 in such a manner that its presence could not be noticeable on the wall of the final PRF container. Information on the progression of the contact front can then be used as further input to computer control of the PRF process. For example, decisions on process variables can be made in response to active input rather than just being predefined in the software that controls the process.

Finite element analysis to optimize the PRF process, for a given product geometry, requires a series of analyses. The first establishes the initial pressure that is to be applied to the undeformed preform. The second and subsequent analyses are to define the pressure-time history that will minimize the total process time, while remaining within the bounds of a failure criterion. Assuming for purposes of illustration that a maximum strain rate will define "failure," if, during the pressurization or expansion of the preform, the strain rate at any position in the expanding preform exceeds a given critical value, failure will occur. The critical strain rate can be determined from tensile, bulge, or other mechanical testing techniques that can establish failure as a function of temperature and strain path. The first analysis simply applies a pressure-ramp loading condition to the preform, over, say, a time of one second, to successively higher pressures, until (say) 90% of the critical strain rate is reached. This pressure value, $P_1$, would become the loading condition of the first step of a multi-step FEA process to produce a product in a minimum time. The remaining analyses are computed by a series of "jobs" with the shape and "state" output from one becoming the input to the next. The pressure boundary condition would be reduced by, say, 10% for each successive job and the analysis would be repeated. In this manner, a plot of pressure vs. process time would be obtained that would guarantee that a critical strain rate (and thus failure) would not be reached during the forming operation.

In summary, the logic and FEA output for report is as follows:

Initial step: determine the maximum pressure that can be applied to the (undeformed) preform. Ramp pressure until the maximum allowable strain rate (say, 0.1 $s^{-1}$) is reached. Back off to define the stress for the first, constant pressure, step.

Next and subsequent steps:

(a) apply pressure;

(b) monitor strain rate (failure criterion) as preform expands: define critical condition;

(c) decrease pressure;

(d) go to a.

A specific optimization/control technique for decreasing cycle time (from currently about 20 sec. to e.g. about 4 sec.) involves applying a rapid series of repeating sequences during which the strain is first increased to a point just below the failure limit and then dropped back to a lower value, which gives the strain rate curve a saw tooth pattern. Currently, a low rate of constant pressure is used to expand the preform.

To illustrate further an analysis procedure for developing such a pressure-time history, let it be assumed that a strain rate greater than $0.2^{s-1}$ will cause a split (failure) in a particular workpiece. To maximize strain rate while staying below the critical value, iterative finite element analyses on a preform are performed, with a given time increment and progressive increments of pressure, until a pressure is reached at which the critical strain rate is exceeded for at least one element. The pressure value is reduced, and finite element analyses are continued at the second lower pressure for time increments until the critical strain rate is again exceeded. These steps are repeated to develop a complete pressure-time history for expansion of the preform from its initial dimensions to the die wall.

One example of such a pressure-time history developed by FEA is represented in FIG. 22, and the corresponding strain rate history is shown in FIG. 23. FIG. 22 compares a varied pressure model in accordance with the present invention to a constant pressure model as heretofore used. In the varied pressure model, net internal fluid pressure in the preform is increased from 0 to 200 psi in the first second, and held at 200 psi for about four seconds; during this time increment, the maximum strain rate (FIG. 23) of any element initially spikes at less than $0.14^{s-1}$, falls off as the preform begins to expand, and then rises to the limiting value of $0.2^{s-1}$ at the end of four seconds. The pressure is reduced in six steps of about 10 psi each and held for a fraction of second at each step; the maximum strain rate drops abruptly with each pressure decrease but then rises rapidly to the limiting value. However, the sequence of pressure drops prevents the maximum strain rate from exceeding the limiting value. At about six seconds, with the pressure at about 140 psi, the workpiece reaches the die wall.

In contrast, with the constant-pressure model, the initial increase in pressure is arrested at only 140 psi at one second and the pressure is held at that level (to prevent excessive strain rate) until the workpiece reaches the die wall after about 18 seconds. Even so, FIG. 23 shows that the maximum strain rate for the constant pressure model is just above the limiting value when the workpiece reaches the die wall.

The great decrease in cycle time provided by the variable pressure model is attributable to the significantly greater initial and subsequent (even though decreasing) pressures permitted by the stepwise variation of pressure-time conditions, while the repeated pressure decreases prevent the maximum strain rate from exceeding the limiting value, as represented by the saw-tooth pattern of FIG. 23.

Another example, with the varied pressure model attaining an initial peak pressure of 250 psi, is represented in FIGS. 24 (pressure vs. time) and 25 (maximum strain rate vs. time). The results are similar, although the cycle time is reduced further, as evidenced by the fact that the workpiece reaches the die wall in only four seconds. The same constant pressure model is included in FIGS. 24 and 25 for comparison.

Figure 26A:
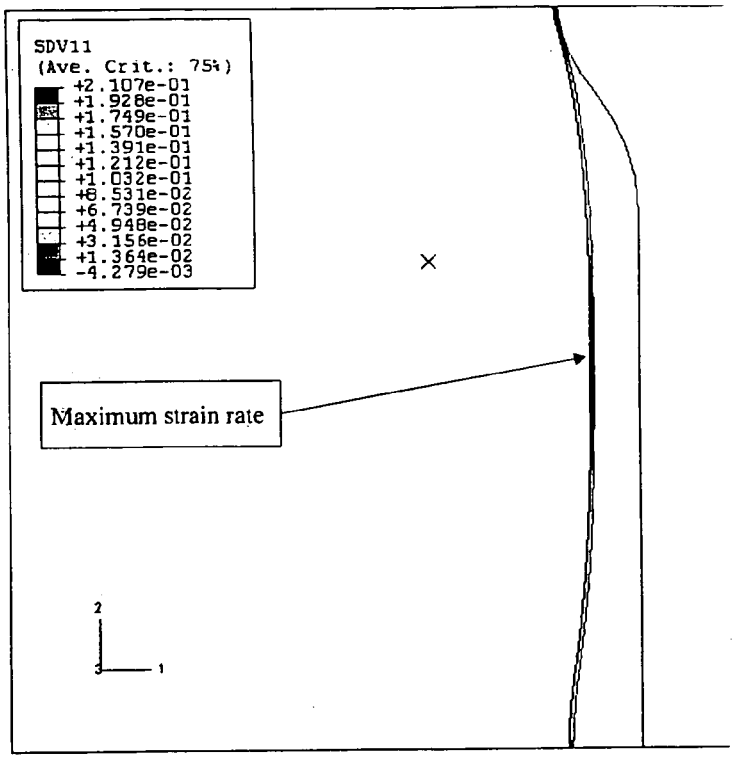
Figure 26B:
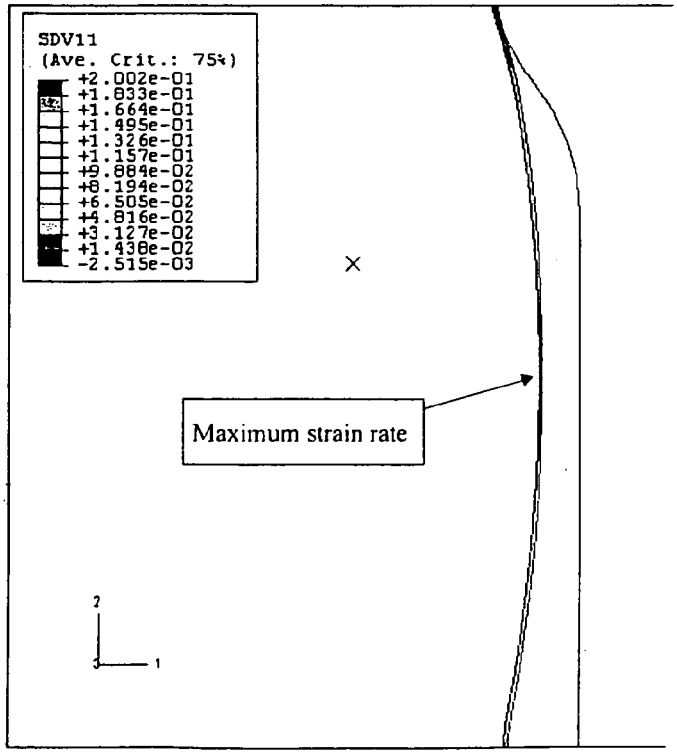
Figure 26C:
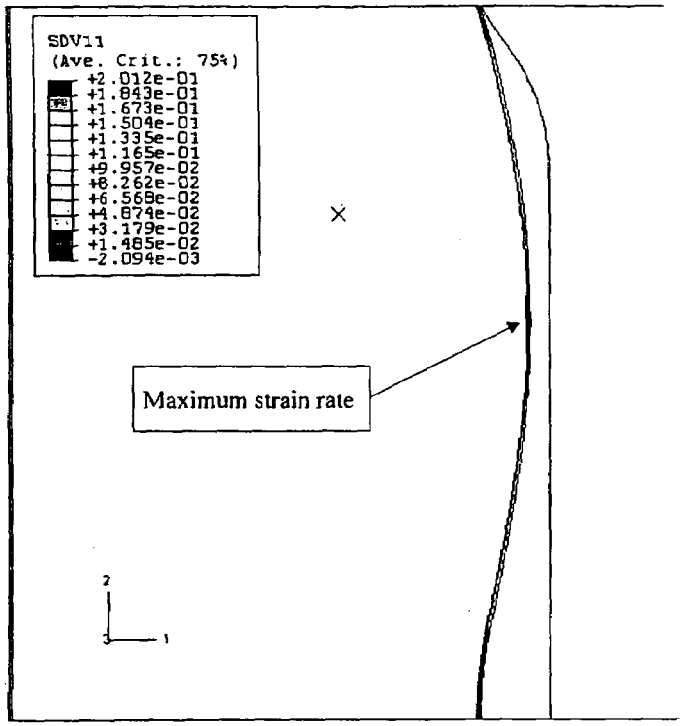
Figure 26D:
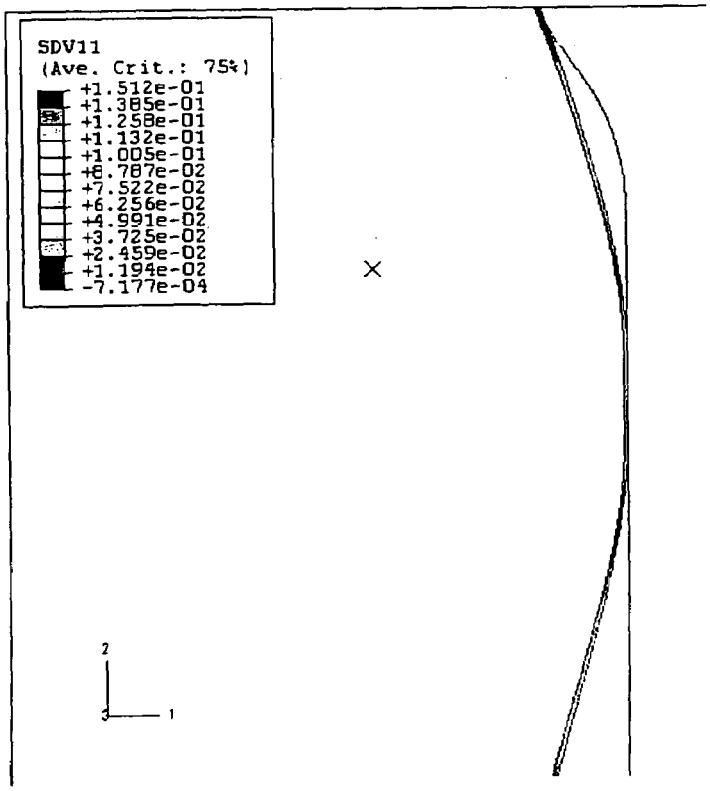

FIGS. 26A, 26B, 26C and 26D show four iterations in the development of the varied pressure model of FIGS. 22 and 23 by finite element analyses. The first iteration, in FIG. 26A, represents attainment of maximum stain rate at the first (highest) pressure. The others represent the third, fifth and seventh time increments, the last being that at which the workpiece reaches the die wall.

FIG. 27 is a simplified diagram illustrating an embodiment of the invention as applied to the control of a pressure-ram-forming process, to optimize pressure-time history, i.e., to reduce or minimize cycle time, thereby increasing production speed. In FIG. 27, the die 10, punch 12, ram 14 and pressure fitting 16 may be essentially as shown in FIGS. 1–2B, for forming a preform (not shown in FIG. 27) such as preform 18 of FIG. 2A into a container. A computer 320 controls the supply of internal fluid pressure through fitting 16 to the preform within the die, as well as translation of the ram 14 to move the punch and operation of one or more heating elements (not shown) in the die and/or ram-punch assembly to subject the preform to selected or predetermined temperature conditions during forming, e.g. as described above with reference to FIG. 10. Temperature information is transmitted to the computer as indicated by lines 322 from one or more thermocouples (not shown) within the die and/or within the ram or punch.

A continuity probe (not shown in FIG. 27, but of the same type as the probe 300 illustrated in FIGS. 19–21) is disposed in the die, exposed at the die wall, and as indicated at 324 is connected to the computer. When the expanding preform within the die reaches the die wall at the location of the probe, the computer is signaled that the preform has reached the die wall at the location of the exposed probe. Computer control of process operations is responsive to the information thus received from the thermocouple and/or the continuity probe.

The computer controls the supplied net internal fluid pressure in conformity with a predetermined optimized pressure-time history. From selected parameters such as preform configuration, dimensions and material properties as well as temperature conditions applied to the preform and the defined shape and dimensions of the container to be formed, a failure criterion (e.g. limiting value of strain rate) is determined, which if exceeded would result in failure such as a pinhole or split in the produced article, and iterative finite element analyses are performed to develop an optimized pressure-time history 332 defining boundary pressure-time conditions within which the failure criterion will not be exceeded, and therefore failure will not occur, at any location or element in the preform, throughout the entire pressure-ram-forming process. This pressure-time history may be of the type represented in FIG. 22 or 24. It is supplied to the control logic of the computer 320, which then controls the pressure conditions in the process in accordance therewith.

That is to say, at the outset of the pressure-ram-forming process, with the preform disposed in the die as in FIG. 2A and the initial punch position and thermal conditions established, the computer causes the net internal fluid pressure within the preform to increase rapidly (typically, within one second) to an initial, maximum value, and to be held at that value for a predetermined relatively brief time interval, during which the maximum plastic strain rate (at any location or element in the preform) rises initially to a value below the limiting value (failure criterion), falls off as the preform begins to expand, and rises again to approach the limiting value. Before the strain rate exceeds the limiting value, the computer causes the pressure to be reduced to a somewhat lower level, and held at that level for a second interval. The strain rate drops with the reduction in pressure but quickly rises to approach the limiting value once more; the computer reduces the pressure further, and so by successive decrements of pressure, and pressure-holding intervals short enough to limit the rises in strain rate, all conforming to the supplied pressure-time history, pressure-ram-forming is completed without failure yet in an advantageously short cycle time.

There is an optimum pressure-time history that will give a minimum cycle time for each container shape and alloy. The process of the invention may be used with all the embodiments and modifications of pressure-ram-forming described above, and with other modifications as well. When both internal and external pressure are applied to the preform, and independently controlled, the computer controls both pressures in accordance with a supplied pressure-time history developed by iterative finite element analyses in the described manner. In its broader aspects, the invention may be applied to other pressure-forming procedures, including conventional hydroforming, as well.

For an additional description of the foregoing aspects of the method and process of the invention, reference may be made to the 16-page document entitled "A method for the Optimization of boundary conditions and Computer Control of complex forming processes Such as Pressure Ram Forming" (dated May 13, 2004 on each page) which is attached to and incorporated by reference in U.S. provisional patent application No. 60/571,472 and is incorporated in its entirety by reference herein.

Active Seal-Ram Pressure Ram Forming

FIGS. 28, 29 and 30 are views similar to FIG. 13, but considerably simplified, illustrating an embodiment of a modified PRF process and apparatus in accordance with a further aspect of the invention. In this modified process and apparatus, an upper sealing ram 416 (corresponding in other respects to the sealing ram 216 of FIG. 13) is movable, during the PRF process, while having the bottom punch 412 and bottom ram 414 are static. In an alternative embodiment, both rams 416 and 414 provide simultaneous motion during forming, while in still another embodiment the bottom punch and ram are omitted entirely and the bottom of the die cavity is closed by bottom portions of a static die. The upper sealing ram 416 is secured to and movable with an upper movable die portion 419 which slides (in directions along the axis of the die cavity) within an enlarged indentation 420 in the main die structure 425 during the forming process. The preform 421 and sealing ram 416 are rigidly held by the movable die 419.

In the illustrated apparatus, the inner wall 425*a* of the lower portion of the die structure, below indentation 420, constitutes a fixed lower portion of the die wall defining die cavity 411, adjacent the closed cavity end provided by static punch-ram 412–414, while the lateral inner wall 419*a* of movable die wall 419 constitutes a movable upper portion of the cavity-defining die wall. The dies are typically or preferably split dies as in the case of the apparatus described above. The sealing ram may carry a heater bayonet 431 which extends into the interior of the preform 421; gas or other fluid providing net internal fluid pressure is introduced to the preform interior through the sealing ram portion.

In the embodiment of FIGS. 28–30, in which heating arrangements may be as described for the apparatus of FIG. 13, expansion of the preform begins at the bottom (in contact with the heated, static ram structure 412–414) and is completed just as the motion of the sealing ram-movable die assembly 416–419 holding the preform is stopped by the lower shoulder 420*a* of the indented portion. A contact probe 300 of the type described above senses the contact of the expanding preform with a selected location on the die wall 430 and coordinates the final motion of the assembly and the completion of the forming process.

This process may be used as an alternative to the PRF process described in the aforementioned copending application to form shaped containers from metal sheet. In basic principles it is generally similar to the proven PRF technology as there described, but it differs in respect of the temperature gradient required and the motions of the lower ram 414 and the sealing ram 416. In conventional PRF, the lower ram moves to prevent "blow-out" failure and to impart the desired bottom profile. In the embodiment of FIGS. 28–30 the lower ram 414 is fixed and passive, and the upper sealing ram 416 performs all control functions, including maintaining contact with the lower ram punch 412 to prevent blow-out failure.

The process and apparatus of FIGS. 28–30 provide for fixed limits (in particular, the limit defined by shoulder 420*a*) for the motion of tooling, specifically the sealing ram, and thus removes some of the uncertainty associated with the position of the ram in the conventional PRF process. It also provides for a wall sensor to detect the position of the expanding preform and to trigger (via computer control) the motion of the moving die to its final position. Control of net internal fluid pressure may be effected in accordance with the present invention in the manner described above with reference to FIGS. 17–27.

FIG. 28 shows the apparatus in the initial condition, with the preform 421 resting on the lower ram punch 412 and movable die 419 and sealing ram 416 in their highest positions. The process begins as internal pressure is applied through the sealing ram to the preform. Simultaneously the sealing ram 416 and the movable die 419 begin to move down at a pre-programmed rate, keeping an axial load on the preform.

FIG. 29 shows the process about 75% of the way to completion. The sealing ram and associated movable die have moved down and the preform has expanded due to the internal pressure. Since the temperature of the preform is higher at the bottom, the expansion process initiates there and progresses up the wall of the die. At the stage represented in FIG. 29, the probe has not yet detected the passage of the expanding preform.

FIG. 30 shows the final position and a fully-formed bottle. As the expanding preform passed over the contact probe 300, it would have sent a signal to the control computer that could have been used to signal the moving die 419 to move rapidly to its final position.

Enhancement of Product Properties

In the two-step forming process described in the aforementioned copending application with reference to FIGS. 4A–4D discussed above, a preform is first partially expanded in a static die and the final forming is a PRF process taking place in a second mold with a movable ram.

Alternatively, and in at least some instances preferably, such a two step process may be conducted in a way that is the reverse of that procedure; i.e., the PRF process may be performed as a first step, with the final forming performed in a static mold. This works especially well when the first step is at an elevated temperature, and the second step is at room temperature to induce strain hardening in the walls of the container. Optionally, the second step can also employ a movable ram, depending on the design of the container or other hollow metal article to be formed, and the alloy used to make the preform.

In other embodiments of the invention, the preform is made from a precipitation hardening alloy, such as an AlMgSi alloy, and undergoes only a single step of PRF cycle, with the side walls being later strengthened by natural or artificial age hardening.

That is to say, the mechanical properties of a pressure-ram-formed article such as a container, immediately after the forming operation, may be insufficient with respect to axial load (related to the ability to form a crown closure) or to dome reversal (related to internal pressure). To rectify the situation, the container may first be partially formed at elevated temperatures by a PRF process and subsequently expanded at room temperature to the final desired shape, possibly again requiring a ram as for the high temperature operation. In this manner, a cold-worked state is produced in the metal and the strength is increased significantly.

A second option is to use a precipitation-hardening alloy for the preform, with appropriate modification of the preform manufacturing process to accommodate the change in the limiting draw ratio; the PRF process then proceeds essentially as with current practice. At the temperatures of the PRF process, the solute is entirely in solid solution. On cooling after the PRF process, some precipitation occurs and the strength of the container increases. Depending on the kinetics of the precipitation, natural aging at room temperature or forced ageing at a modest elevated temperature would achieve a higher strength and improved properties of the PRF product. Mg—Si aluminum alloys, producing $Mg_2Si$ precipitates, exemplify alloys for PRF applications.

It is to be understood that the invention is not limited to the procedures and embodiments hereinabove specifically set forth but may be carried out in other ways without departure from its spirit.

What is claimed is:

1. A method executed by a computer system as part of a computer-implemented program for optimizing pressure-time history for a process for forming a workpiece from an initial hollow metal preform into a hollow metal article within a die by subjecting the workpiece to net internal fluid pressure such that the workpiece expands into contact with an article-shape-defining wall of the die, while avoiding failure of the workpiece, comprising the steps of (a) selecting a set of process parameters including temperature and preform material properties and dimensions;

(b) determining, from said set of parameters, at least one failure criterion limiting pressure-time conditions to which the workpiece may be subjected without failure; and (c) iteratively performing finite element analyses on the workpiece, based on the selected set of parameters and the determined failure criterion, at each of a plurality of different values of pressure-time conditions (P, t), to determine pressure-time boundary conditions ($P_b$, $t_b$) for the process, wherein each value of pressure-time conditions comprises a value of net internal fluid pressure (P) and a time interval (t) over which the last-mentioned value of net internal fluid pressure is applied to the workpiece.

2. A method according to claim 1, wherein said failure criterion is selected from the group consisting of minimum wall thickness, strain, and strain rate.

3. A method according to claim 1, wherein step (c) includes selecting a time interval and iteratively performing said finite element analyses on the workpiece at each of a plurality of different pressure values, to determine, as a boundary condition, a value of maximum net internal fluid pressure to which the workpiece can be subjected for said time interval without failure.

4. A method executed by a computer system as part of a computer-implemented program for optimizing pressure-time history for a process for forming a workpiece from an initial hollow metal preform into a hollow metal article within a die by subjecting the workpiece to net internal fluid pressure such that the workpiece expands into contact with an article-shape-defining wall of the die, while avoiding failure of the workpiece, comprising the steps of (a) selecting a first set of process parameters including temperature and preform material properties and dimensions;

(b) determining, from said first set of parameters, at least one first failure criterion limiting pressure-time conditions to which the workpiece may be subjected without failure;

(c) iteratively performing finite element analyses on the workpiece, based on the first set of parameters and the determined first failure criterion, at each of a plurality of different values of pressure-time conditions (P, t), to determine first pressure-time boundary conditions ($P_{b1}$, $t_{b1}$) for the process;

(d) determining a second set of process parameters corresponding to said first set of process parameters but modified by deformation imposed on the workpiece by subjection to said first pressure-time boundary conditions ($P_{b1}$, $t_{b1}$); and (e) repeating steps (b) and (c) to determine, from said second set of process parameters, at least one second failure criterion and to determine, by iteratively performed finite element analyses based on the second set of parameters and the determined second failure criterion, second pressure-time boundary conditions ($P_{b2}$, $t_{b2}$) for the process.

5. A method according to claim 4, including repeating steps (d) and (e) to determine a plurality n of pressure-time boundary conditions wherein 3<n; and wherein, for each integer i such that 3<i<n, the ith set of process parameters corresponds to the (i−1)th set of process parameters but modified by deformation imposed on the workpiece by subjection to the (i−1)th pressure-time boundary conditions ($P_{bi-1}$, $t_{bi-1}$), the ith failure criterion is determined from the ith set of process parameters, and the ith pressure-time boundary conditions ($P_{bi}$, $t_{bi}$) are determined by iteratively performed finite element analyses based on the ith set of parameters and the determined ith failure criterion, thereby to determine n successive sets of pressure-time boundary conditions ($\{P_{b1}, t_{b1}\}, \ldots \{P_{bn}, t_{bn}\}$) collectively constituting an optimized pressure-time history for said process.

6. A method according to claim 5, wherein at least one set of pressure-time boundary conditions is determined by iteratively performed finite element analyses as aforesaid at each of a plurality of values of pressure (P) for a preselected value of time (t).

7. A method according to claim 5, wherein at least one set of pressure-time boundary conditions is determined by iteratively performed finite element analyses as aforesaid at each of a plurality of values of time (t) for a preselected value of pressure (P).

8. A method for forming a hollow metal article of defined shape and lateral dimensions, comprising the steps of (a) disposing a hollow metal preform having a closed end in a die cavity laterally enclosed by a die wall defining said shape and lateral dimensions, the preform closed end being positioned in facing relation to one end of the cavity and at least a portion of the preform being initially spaced inwardly from the die wall, and (b) under control of a computer, subjecting the preform to net internal fluid pressure to expand the preform outwardly into substantially full contact with the die wall, thereby to impart said defined shape and lateral dimensions to the preform, said fluid pressure exerting force, on said closed end, directed toward said one end of the cavity, wherein the improvement comprises:

(c) supplying, to said computer, an optimized pressure-time history for said form methed determined by the method of claim 5, and (d) performing step (b) by subjecting the preform to n successive sets of pressure-time conditions respectively corresponding to n successive sets of pressure-time boundary conditions ($\{p_{b1}, t_{b1}\}, \ldots \{P_{bn}, t_{bn}\}$) constituting said optimized pressure-time history determined by the method of claim 5.

9. A process for forming a hollow metal article of defined shape and lateral dimensions, comprising the steps of (a) disposing a hollow metal preform having a closed end in a die cavity laterally enclosed by a die wall defining said shape and lateral dimensions, the preform closed end being positioned in facing relation to one end of the cavity and at least a portion of the preform being initially spaced inwardly from the die wall, and (b) subjecting the preform to net internal fluid pressure to expand the preform outwardly into substantially full contact with the die wall, thereby to impart said defined shape and lateral dimensions to the preform, said fluid pressure exerting force, on said closed end, directed toward said one end of the cavity, wherein the improvement comprises:

(c) performing step (b) by subjecting the preform to a succession of sets of pressure-time conditions (p, t), respectively having successively decreasing values of net internal fluid pressure, said succession of sets of pressure-time conditions being within predetermined boundary conditions for the process.

10. A process for forming a hollow metal article of defined shape and lateral dimensions, comprising (a) disposing a hollow metal preform having a closed end in a die cavity laterally enclosed by a die wall defining said shape and lateral dimensions, with a punch located at one end of the cavity and translatable into the cavity, the preform closed end being positioned in proximate facing relation to the punch and at least a portion of the preform being initially spaced inwardly from the die wall;

(b) under control of a computer, subjecting the preform to net internal fluid pressure to expand the preform outwardly into substantially full contact with the die wall, thereby to impart said defined shape and lateral dimensions to the preform, said fluid pressure exerting force, on said closed end, directed toward said one end of the cavity; and (c) translating the punch into the cavity to engage and displace the closed end of the preform in a direction opposite to the direction of force exerted by fluid pressure thereon, deforming the closed end of the preform;

wherein the improvement comprises:

(d) supplying, to said computer, pressure-time boundary conditions determined for said process by the method of claim 1, and (e) performing step (b) by subjecting the preform to pressure-time conditions corresponding to the pressure-time boundary conditions determined by the method of claim 1.

11. A process according to claim 10, further including the steps of sensing contact of the preform with a preselected location in the die wall and supplying information representative of the sensed contact to the computer, and wherein computer control of the process is responsive to the supplied contact information.

12. A process according to claim 10, further including the steps of sensing temperature conditions to which the preform is subjected during performance of the process and supplying information representative of the sensed temperature conditions to the computer, and wherein computer control of the process is responsive to the supplied temperature information.

13. A process according to claim 10, wherein said hollow metal article is a metal container.

14. A process for forming a hollow metal article of defined shape and lateral dimensions, comprising (a) disposing a hollow metal preform having a closed end in a die cavity laterally enclosed by a die wall defining said shape and lateral dimensions, with a punch located at one end of the cavity and translatable into the cavity, the preform closed end being positioned in proximate facing relation to the punch and at least a portion of the preform being initially spaced inwardly from the die wall;

(b) under control of a computer, subjecting the preform to net internal fluid pressure to expand the preform outwardly into substantially full contact with the die wall, thereby to impart said defined shape and lateral dimensions to the preform, said fluid pressure exerting force, on said closed end, directed toward said one end of the cavity; and (c) translating the punch into the cavity to engage and displace the closed end of the preform in a direction opposite to the direction of force exerted by fluid pressure thereon, deforming the closed end of the preform;

wherein the improvement comprises:

(d) determining, for said preform, a failure criterion limiting pressure-time conditions to which the workpiece may be subjected without failure;

(e) by iteratively performing finite element analyses on the preform, developing a pressure-time history for the preform comprising an initial value of net internal fluid pressure, an initial time interval during which said initial value is to be applied to the preform, a plurality of sequential time intervals following said initial interval, and a corresponding plurality of successively lower values of net internal fluid pressure to be respectively applied to the preform during said plurality of sequential time intervals, wherein the values of internal fluid pressure and the durations of the time intervals are such that the failure criterion is never exceeded throughout said pressure-time history;

(f) supplying, to said computer, said pressure-time history; and (g) performing step (b) by subjecting the preform to said pressure-time history.

15. A process according to claim 14, wherein said failure criterion is a limiting value of strain rate.

16. Apparatus for forming a hollow metal article of defined shape and lateral dimensions from a hollow metal preform having a closed end, comprising (a) die structure providing a die cavity for receiving the preform therein with at least a portion of the preform being initially spaced inwardly from the die wall and the preform closed end facing one end of the cavity, said cavity having a die wall defining said shape and lateral dimensions;

(b) a punch located at one end of the cavity and translatable into the cavity such that the closed end of a preform received within the cavity is positioned in proximate facing relation to the punch;

(c) a fluid pressure supply for subjecting a preform within the cavity to net internal fluid pressure to expand the preform outwardly into substantially full contact with the die wall, thereby to impart said defined shape and lateral dimensions to the preform, said fluid pressure exerting force, on said closed end, directed toward said one end of the cavity; and (d) a computer for controlling at least one of supply of fluid pressure and translation of the punch;

wherein the improvement comprises:

(e) at least one sensor positioned at a location in the die wall to sense contact of the preform with the die wall at that location, the sensor supplying information representative of the sensed contact to the computer, and computer control of the process being responsive to the supplied contact information.

17. Apparatus as defined in claim 16, wherein said sensor comprises an electrical conductor exposed at the die wall at said location, said conductor being connected to said computer such that when the preform comes into contact with the die wall, an electrical circuit is closed, contact information is supplied to said computer.

18. Apparatus as defined in claim 16, further including at least one sensor for sensing temperature conditions to which the preform is subjected during performance of the process and supplying information representative of the sensed temperature conditions to the computer, and wherein computer control of the process is responsive to the supplied temperature information.

19. A process for forming a hollow metal article of defined shape and lateral dimensions, comprising (a) disposing a hollow metal preform having opposed ends, one of which is closed, in a die cavity laterally enclosed by a die wall defining said shape and lateral dimensions, the cavity having an axis and a closed inner end faced by the preform closed end, at least a portion of the preform being initially spaced inwardly from the die wall, and a ram translatable axially of the cavity toward the closed inner end and arranged to exert force on the other end of the preform in a direction toward the closed end of the cavity;

(b) subjecting the preform to net internal fluid pressure to expand the preform outwardly into substantially full contact with the die wall, thereby to impart said defined shape and lateral dimensions to the preform, said fluid pressure exerting force, on said closed end, directed toward said one end of the cavity; and (c) translating the ram to displace said other end of the preform toward the closed end of the die cavity.

20. A process according to claim 19, wherein the die wall comprises a fixed portion adjacent said closed end of the cavity and a movable portion slidable axially of the die cavity and arranged for movement with the ram toward the closed end of the die cavity from an initial position at which said fixed and movable portions are spaced apart to a limiting position at which said fixed and movable die wall portions are contiguous, the step of translating the ram causing the movable portion of the die wall to move therewith from said initial position to said limiting position.

21. A process according to claim 19, wherein the closed end of the die cavity is closed by a punch translatable into the cavity.

22. A process according to claim 21, wherein the preform closed end is positioned in proximate facing relation to the punch, and including the step of translating the punch into the cavity to engage and displace the closed end of the preform in a direction opposite to the direction of force exerted by fluid pressure thereon, deforming the closed end of the preform.

23. A process according to claim 20, wherein translation of the ram is under control of a computer, and further including the steps of sensing contact of the preform with a preselected location in the die wall and supplying information representative of the sensed contact to the computer, computer control of the ram translation being responsive to the supplied contact information.

24. A process for forming a hollow metal article of defined shape and lateral dimensions, comprising (a) disposing a hollow metal preform having opposed ends, one of which is closed, in a die cavity laterally enclosed by a die wall defining said shape and lateral dimensions, the cavity having an axis and a closed inner end faced by the preform closed end, at least a portion of the preform being initially spaced inwardly from the die wall, and a ram translatable axially of the cavity toward the closed inner end and arranged to exert force on the other end of the preform in a direction toward the closed inner end of the cavity;

(b) subjecting the preform to net internal fluid pressure under control of a computer to expand the preform outwardly into substantially full contact with the die wall, thereby to impart said defined shape and lateral dimensions to the preform, said fluid pressure exerting force, on said closed end, directed toward said one end of the cavity;

(c) translating the ram to displace said other end of the preform toward the closed end of the die cavity;

(d) supplying, to said computer, pressure-time boundary conditions determined for said process by the method of claim 1, and (e) performing step (b) by subjecting the preform to pressure-time conditions corresponding to the pressure-time boundary conditions determined by the method of claim 1.

25. Apparatus for forming a hollow metal article of defined shape and lateral dimensions from a hollow metal preform having opposed ends of which one is closed, comprising (a) die structure providing a die cavity having an axis and a die wall defining said shape and lateral dimensions, for receiving the preform therein with at least a portion of the preform being initially spaced inwardly from the die wall and the preform closed end facing one end of the cavity, said one end of the cavity being closed;

(b) a ram translatable axially of the cavity toward the closed inner end and disposed to exert force on the other end of the preform in a direction toward the closed inner end of the cavity; and (c) a fluid pressure supply for subjecting a preform within the cavity to internal fluid pressure to expand the preform outwardly into substantially full contact with the die wall, thereby to impart said defined shape and lateral dimensions to the preform, said fluid pressure exerting force, on said closed preform end, directed toward said one end of the cavity.

26. Apparatus as defined in claim 25, wherein the die wall comprises a fixed portion adjacent said closed end of the cavity and a movable portion slidable axially of the die cavity and arranged for movement with the ram toward the closed end of the die cavity from an initial position at which said fixed and movable portions are spaced apart to a limiting position at which said fixed and movable die wall portions are contiguous, the step of translating the ram causing the movable portion of the die wall to move therewith from said initial position to said limiting position.

27. Apparatus as defined in claim 26 wherein said die structure includes an enlarged indentation, for slidably receiving said movable portion of the die wall, spaced from the closed end of the cavity by the fixed die wall portion.

28. Apparatus as defined in claim 26, further including a punch closing said closed end of the die cavity.

29. Apparatus as defined in claim 28, wherein the punch is translatable into the cavity to engage and displace the closed end of the preform in a direction opposite to the direction of force exerted by fluid pressure thereon.

30. Apparatus as defined in claim 26, further including a computer for controlling movement of the ram, and a sensor for sensing contact of the preform with a preselected location in the die wall and supplying information representative of the sensed contact to the computer.

31. A process for forming a hollow metal article of defined shape and defined final lateral dimensions, comprising (a) disposing a hollow metal preform having a closed end in a first die cavity laterally enclosed by a die wall defining a first shape and first lateral dimensions, smaller than said defined final lateral dimensions, with a punch located at one end of the cavity and translatable into the cavity, the preform closed end being positioned in proximate facing relation to the punch and at least a portion of the preform being initially spaced inwardly from the die wall;

(b) subjecting the preform to net internal fluid pressure to expand the preform outwardly into substantially full contact with the die wall, thereby to impart said first shape and first lateral dimensions to the preform, said fluid pressure exerting force, on said closed end, directed toward said one end of the cavity; and (c) translating the punch into the cavity to engage and displace the closed end of the preform in a direction opposite to the direction of force exerted by fluid pressure thereon, deforming the closed end of the preform, thereby to form said preform into a workpiece having said first shape and first lateral dimensions and having a closed end;

wherein the improvement comprises:

(d) thereafter placing the workpiece in a second die cavity defining said final shape and final lateral dimensions and subjecting the workpiece therein to net internal fluid pressure to expand the workpiece to said final shape and final lateral dimensions.

32. A process according to claim 31, wherein said second die cavity is formed in a static die.

33. A process according to claim 31, wherein said second die cavity is provided with a punch located at one end of the cavity and translatable into the cavity, and wherein step (d) further comprises positioning the workpiece closed end in proximate facing relation to the last-mentioned punch and translating the punch into the cavity to engage and displace the closed end of the workpiece in a direction opposite to the direction of force exerted by fluid pressure thereon, thereby to form said workpiece into an article having said final shape and final lateral dimensions.

34. A process for forming a hollow metal article of defined shape and defined final lateral dimensions, comprising (a) disposing a hollow metal preform having a closed end in a first die cavity laterally enclosed by a die wall defining a first shape and first lateral dimensions, smaller than said defined final lateral dimensions, with a punch located at one end of the cavity and translatable into the cavity, the preform closed end being positioned in proximate facing relation to the punch and at least a portion of the preform being initially spaced inwardly from the die wall;

(b) subjecting the preform to net internal fluid pressure to expand the preform outwardly into substantially full contact with the die wall, thereby to impart said first shape and first lateral dimensions to the preform, said fluid pressure exerting force, on said closed end, directed toward said one end of the cavity; and (c) translating the punch into the cavity to engage and displace the closed end of the preform in a direction opposite to the direction of force exerted by fluid pressure thereon, deforming the closed end of the preform, thereby to form said preform into a workpiece having said first shape and first lateral dimensions and having a closed end;

wherein the improvement comprises:

(d) said workpiece being made of a precipitation-hardening alloy.

35. A process according to claim 34, wherein said alloy is an Al—Mg—Si alloy.

* * * * *